US005548894A

United States Patent [19]

Muto

[11] Patent Number: 5,548,894

[45] Date of Patent: Aug. 27, 1996

[54] INK JET HEAD HAVING INK-JET HOLES PARTIALLY FORMED BY LASER-CUTTING, AND METHOD OF MANUFACTURING THE SAME

[75] Inventor: Mitsuru Muto, Kasugai, Japan

[73] Assignee: Brother Kogyo Kabushiki Kaisha, Nagoya, Japan

[21] Appl. No.: 252,167

[22] Filed: May 31, 1994

[30] Foreign Application Priority Data

| | | | |
|---|---|---|---|
| Jun. 3, 1993 | [JP] | Japan | 5-133573 |
| Oct. 26, 1993 | [JP] | Japan | 5-266904 |
| May 20, 1994 | [JP] | Japan | 6-106802 |

[51] Int. Cl.[6] ..... B41J 2/135

[52] U.S. Cl. ..... 29/890.1; 347/47

[58] Field of Search ..... 29/890.1; 347/46, 347/47

[56] References Cited

U.S. PATENT DOCUMENTS

| | | | |
|---|---|---|---|
| 5,189,437 | 2/1993 | Michaelis et al. | 347/47 |
| 5,208,604 | 5/1993 | Watanabe et al. | 347/47 |
| 5,305,018 | 4/1994 | Schantz et al. | 347/47 |
| 5,312,517 | 5/1974 | Ouki | 347/47 |
| 5,389,954 | 2/1995 | Inaba et al. | 347/47 |
| 5,408,738 | 4/1995 | Schantz et al. | 29/611 |
| 5,408,739 | 4/1995 | Altavela et al. | 29/611 |
| 5,417,897 | 5/1995 | Asakawa et al. | 347/47 |

FOREIGN PATENT DOCUMENTS

| | | |
|---|---|---|
| 0278590 | 8/1988 | European Pat. Off. . |
| 0277703 | 8/1988 | European Pat. Off. . |
| 0278589 | 8/1988 | European Pat. Off. . |
| 0309146 | 3/1989 | European Pat. Off. . |
| 61-32761 | 2/1986 | Japan . |
| 63-31758 | 2/1988 | Japan . |
| 3-297651 | 12/1991 | Japan . |
| WO91/17051 | 11/1991 | WIPO . |

*Primary Examiner*—Irene Cuda
*Assistant Examiner*—Marc W. Butler
*Attorney, Agent, or Firm*—Oliff & Berridge

[57] ABSTRACT

A method of manufacturing an ink jet head including an ink-chamber member having ink chambers, and a nozzle plate secured to a front end face of the ink-chamber member and which has ink-jet holes communicating with the respective ink chambers, wherein a blank for the nozzle plate is formed by injection molding, such that blind holes are formed in one of opposite surfaces of the blank and such that each blind hole has a varying-area portion whose cross sectional area decreases in a direction from the above-indicated one of opposite surfaces of the blank toward the other surface, and the blank is subjected to laser-cutting to prepare the nozzle plate having orifice holes which cooperate with the blind holes to form the ink-jet holes. The size of each blind hole at an open end thereof is preferably smaller than the size of the ink chamber at an end thereof at which the ink chamber communicates with the ink-jet hole.

22 Claims, 18 Drawing Sheets

INK JET HEAD HAVING INK-JET HOLES PARTIALLY FORMED BY LASER-CUTTING, AND METHOD OF MANUFACTURING THE SAME

BACKGROUND OF THE INVENTION

1. Field of the Invention

The present invention relates generally to an ink jet head and a method of manufacturing the ink jet head, and more particularly to a technique for forming ink-jet holes of the head.

2. Discussion of the Related Art

An ink jet head using actuator elements for producing an ink jetting energy for each ink-jet hole is known as a so-called "drop-on-demand" type ink jet head. For instance, the actuator element uses a piezoelectric ceramic material which undergoes deformation upon electric energization thereof, to change a volume of an ink chamber filled with an ink, so that a droplet of the ink is jetted through an ink-jet hole communicating with the ink chamber, when the volume of the ink chamber is reduced. When the volume of the ink chamber is increased, a certain amount of the ink is introduced into the ink chamber through an ink inlet. The actuator elements corresponding to the ink chambers are selectively energized according to printing data, so that the ink droplets are jetted from the ink-jet holes corresponding to the energized actuator elements, whereby a desired image such as a character or graphical representation is formed in a matrix of dots in the form of the ink droplets on an appropriate recording medium such as a paper sheet or web placed in opposed relationship with the ink jet head.

An example of this type of ink jet head is disclosed in EP-A-0277703, EP-A-0278589 and EP-A-0278590.

WO91/17051 discloses an ink jet head having a high density of ink-jet holes, in which the ink-jet holes are formed in two parallel rows.

The ink jet head disclosed in EP-A-0277703, EP-A-0278589 and EP-A-0278590 indicated above is shown generally at 1 in FIG. 14. This ink jet head 1 consists of a piezoelectric ceramic plate 2, a cover plate 3, a nozzle plate 31 and a substrate 41.

The piezoelectric ceramic plate 2 is subjected to a polarization treatment in which the plate 2 is polarized in a direction indicated by an arrow 5 in FIG. 16. The polarized plate 2 is then subjected to a machining operation in which a plurality of parallel grooves 8 are formed by suitable cutting tool such as a diamond blade in the form of a disk having a small thickness, which defines the width of each groove 8. The parallel grooves 8 are defined by parallel partition walls 11 which are equally spaced apart from each other in a direction perpendicular to the direction of extension of the grooves 8. The parallel grooves 8 have a constant depth over a predetermined length from a front end face 4 of the plate 2, and terminate into respective shallow grooves 16 formed adjacent to a rear end face 15 of the plate 2. Namely, the depth of the rear end portion of each groove 8 decreases as it approaches the shallow groove 16. A pair of metal electrodes 13 are formed by a suitable film-forming technique such as sputtering, in the form of strips on upper halves of the opposed side surfaces of the adjacent partition walls 11 which define each groove 8. Metal electrodes 9 are formed by sputtering, for example, on the opposed side surfaces of the partition walls 11 which define each shallow groove 16, and also on the bottom surface of each shallow groove 16.

The cover plate 3 is formed of a glass material, a ceramic material, a resin material or any other suitable material. The cover plate 3 has an ink inlet 21 and a manifold 22 formed by a suitable technique such as grinding or machining. The piezoelectric ceramic plate 2 and the cover plate 3 are bonded together by an epoxy resin adhesive or other suitable bonding agent, at their surfaces in which the grooves 8 and manifold 22 are formed. Thus, there is prepared an ink-chamber member generally indicated at 26 in FIG. 16, in which the grooves 8 and shallow grooves 16 are closed at their upper openings by the cover plate 3, whereby a plurality of ink chambers 12 are formed. The ink chambers 12 communicate with the manifold 22, at the shallow grooves 16 whose rear ends are closed by the cover plate 3. As indicated in FIG. 16, the ink chambers 12 are equally spaced apart from each other in the direction perpendicular to the direction of extension thereof. Each ink chamber 12 has a rectangular cross sectional shape and has a relatively large length and a relatively small width. In operation of the ink jet head 1, the ink chambers 12 are filled with an ink introduced through the ink inlet 21 and manifold 22.

The ink-chamber member 26 is bonded to the substrate 41 by a suitable bonding agent such as an epoxy resin, at the surface of the piezoelectric ceramic plate 2 which is opposite to the surface in which the grooves 8, 16 are formed. As shown in FIG. 14, the substrate 41 is provided with conductive strips 42 aligned with the respective ink chambers 12. The conductive strips 42 are electrically connected by conductor wires 43 to the respective electrodes 9 which cover the bottom surfaces of the shallow grooves 16.

To the front end face 4 of the ink-chamber member 26, there is bonded the nozzle plate 31 which has a plurality of ink-jet holes 32 arranged in a row such that the ink-jet holes 32 communicate with the respective ink chambers 12.

The conductive strips 42 formed on the substrate 41 are electrically connected to an LSI chip 51, as shown in FIG. 15. To the LSI chip 5, there are connected a clock line 52, a data line 53, a voltage line 54 and a ground line 55. The LSI chip 5 operates according to clock pulses received from the clock line 52, and is adapted to apply a predetermined voltage V of the voltage line 54 to the appropriate conductive strips 42 in response to drive commands received from the data line 53, so that the ink chambers 12 specified by the drive commands are deformed so as to reduce their volume by application of the voltage V through the corresponding pairs of electrodes 13, whereby ink droplets are delivered from the ink-jet holes 32 corresponding to the deformed ink chambers 12. Thus, the drive commands received from the data line 53 specify the ink-jet holes 32 from which the ink droplets are delivered. The conductive strips 42 and electrodes 13 which correspond to the other ink-jet holes 32 are maintained at the ground voltage (0 V) of the ground line 55.

The ink jet head 1 constructed as described above operates as follows:

When the LSI chip 51 receives a drive command to deliver an ink droplet from the ink-jet hole 32 communicating with the ink chamber **12*b* (FIG. 16), for example, the predetermined drive voltage V is applied between the opposed electrodes 13*e* and 13*f*, while the electrodes 13*d* and 13*g* are grounded. As a result, the partition wall 11*b* partially defining the ink chamber 12*b* is exposed to an electric field in a direction indicated by arrow 14*b* in FIG. 17, while the partition wall 11*c* also partially defining the ink chamber 12*b* is exposed to an electric field in a direction indicated by arrow 14***c* in FIG. 17. Since the directions 14*b*, 14*c* of the electric fields are normal to the direction of polarization of the piezoelectric ceramic plate 2 indicated by arrow 5, the partition walls 11*b*, 11*c* undergo deflection or flexure to to a piezoelectric effect. Consequently, the volume of the ink chamber 12*b* is reduced due to the deflection of the partition walls 11*b*, 11*c*, causing a rapid increase of the pressure of the ink within the ink chamber 12*b*, whereby the ink is forced to flow from the ink chamber 12*b* to the ink-jet hole 32 which communicates with the ink chamber 12*b*. Thus, an ink droplet is jetted from that ink-jet hole 32. When the application of the drive voltage V to the electrodes 13*e*, 13*f* is cut off, the partition walls 11*b*, 11*c* are restored relatively slowly to their original position, and the pressure of the ink within the ink chamber 12*b* is lowered at a relatively low rate, whereby a certain amount of the ink is introduced into the ink chamber 12*b* through the ink inlet 21 and manifold 22.

The operation described above is a basic operation of the conventional ink jet head. However, the ink jet head may be operated in various modes. For instance, a drive voltage is applied to the electrodes so as to increase the volume of the selected ink chamber 12*b* to thereby introduce a certain amount of the ink into the ink chamber 12*b*. Then, the drive voltage is removed from the electrodes to restore the ink chamber 12*b* to its original state (FIG. 16) to thereby deliver a droplet of the ink from the ink-jet hole 32.

The nozzle plate 31 having the ink-jet holes 32 used in the ink jet head of the type described above is conventionally produced by performing a suitable operation such as pressing or drilling on a blank to form the ink-jet holes 32, or by using a high-energy beam such as an excimer laser beam to form the ink-jet holes 32 through a sheet-like blank (31), as disclosed in JP-A-61-32761 as indicated in FIG. 18.

Another method of producing a nozzle plate is disclosed in JP-A-3-297651, wherein the nozzle plate is formed by nickel electrocasting or injection molding. Referring to FIGS. 19 through FIG. 22, there will be described conventional methods of producing a nozzle plate by injection molding. A nozzle plate 71 as shown in FIG. 19 is formed by injection molding using a mold as shown in FIGS. 20(*a*) and 20(*b*), while a nozzle plate 81 as shown in FIG. 21 is formed by injection molding using a mold as shown in FIGS. 22(*a*) and 22(*b*). The nozzle plate 71 has ink-jet holes each consisting of an orifice portion 72 and a tapered portion 73 which communicates with the ink chamber 12 when the nozzle plate 71 is bonded to the piezoelectric ceramic plate 3. Similarly, the nozzle plate 81 ink-jet holes each consisting of a orifice portion 82 and a tapered portion 83. FIG. 20(*b*) is a cross sectional view taken along line A—A in FIG. 20(*a*), while FIG. 22(*b*) is a cross sectional view taken along line A—A of FIG. 22(*a*). Reference numerals 170, 180 denote a core used in the mold. The core 170, 180 has a row of projections 173, 183 as shown in FIGS. 20(*b*) and 22(*b*), which correspond to a row of ink-jet holes 72, 73, 82, 83 to be formed in the nozzle plate 71, 81. To form the nozzle plate 71, 81, a suitable material is introduced into the injection mold through a gate 100 to fill a mold cavity which is partially defined by the core 170, 180.

EP-A-0309146 shows a method of forming tapered ink-jet holes by applying an excimer laser beam to a nozzle plate blank while the angle of the axis of the beam relative to the blank is changed.

The nozzle plate is conventionally formed of a resin material or a metal such as stainless steel, nickel, aluminum and chromium. The resin material may be selected from among polyethylene terephthalate, polyimide, polyether imide, polyether ketone, polyether ether ketone, polyether sulfone and polycarbonate.

However, the method of producing the nozzle plate by nickel electrocasting as disclosed in JP-A-3-297651 suffers from a high cost of manufacture, and is not suitable for mass production of the nozzle plate.

On the other hand, the sheet-like nozzle plate 31 whose ink-jet holes 32 are formed by an excimer laser beam as shown in FIG. 18 tends to cause entry of air into the ink chamber 12, due to an insufficient volume of the ink-jet holes 32. The air remaining in the ink chamber 12 prevents smooth jetting of the ink through the ink-yet holes 32, resulting in deterioration of the quality of an image formed by the ink droplets. While the volume of the ink-jet holes 32 can be increased by increasing the thickness of the nozzle plate 31, an increase in the thickness causes difficult formation of the ink-jet holes 32 by the excimer laser beam. Further, an increase in the length of the ink-jet holes 32 results in an increase in the required voltage applied to the electrodes to deliver the ink droplets from the ink-jet holes 32.

The method of producing the nozzle plate by injection molding or forming the ink-jet holes by pressing or drilling also suffers from a problem. That is, the nozzle plate tends to have burrs around the edge of the ink-jet holes on its outer surface, for example, and the direction of jetting of the ink droplets from the ink-jet holes tends to fluctuate, leading to deterioration of the quality of the formed image. Although the injection molding method permits the ink-jet holes to have a sufficiently large volume, burrs 75, 85 are inevitably left at the outer or inner end of the orifice portion 72, 82 as shown in FIGS. 19 and 21. An experiment conducted on the nozzle plates 71, 81 of FIGS. 19 and 21 showed considerable fluctuation of the direction of ink jetting from the orifice portion 72, 82, namely, poor ink jetting stability.

According to the method in which the tapered ink-jet holes are formed by an excimer laser beam by changing the angle of the excimer laser beam path relative to the nozzle plate blank as disclosed in EP-A-0309146, the ink-jet holes can be formed with a sufficiently large volume due to their tapered shape. However, this method requires a long time to form the ink-jet holes, and suffers from low efficiency of mass production of the nozzle plate.

JP-A-63-31758 discloses an integrally formed piezoelectric member which has both ink chambers and ink-jet holes. Each ink-jet hole consists of an orifice portion from which an ink is delivered, and a tapered portion which communicates with the orifice portion and the ink chamber. The tapered portion has a diameter which decreases in a direction from one end adjacent to the ink chamber and the other end adjacent to the orifice portion. The orifice portion has a constant diameter over its entire length between the tapered portion and the outer surface of the nozzle plate. JP-A-63-31758 discloses the use of a laser beam to form the orifice portion.

If the ink-jet holes are formed by first forming tapered blind holes and then removing the bottom wall of the blind holes by a laser beam so as to form the orifice portion communicating with the tapered portion as indicated above, the nozzle plate will not have burrs which would be left around the edge of the orifice portion where the tapered and orifice portions of each ink-jet hole are simultaneously formed by injection molding. The nozzle plate thus formed assures high ink jetting stability.

However, it is difficult to form an integral piezoelectric member which has ink chambers and tapered portions of the ink-jet holes communicating with the ink chambers. In particular, the technique disclosed in JP-A-63-31758 is not applicable to the ink jet head of the type shown in EP-A-0277703, EP-A-0278589 and EP-A-0278590.

SUMMARY OF THE INVENTION

It is therefor a first object of the present invention to provide a method which permits economical manufacture of an ink jet head capable of printing so as to assure high quality of images formed by ink droplets delivered from ink-jet holes communicating with ink chambers.

It is a second object of this invention to provide such method which permits increased yield ratio of the ink jet head.

It is a third object of the invention to provide such method which assures improved production efficiency of the ink jet head.

It is a fourth object of the invention to provide such method which permits ink-jet holes to be formed with high density.

It is a fifth object of the present invention to provide an inexpensive ink jet head which assures high quality of images formed by ink droplets delivered from ink-jet holes communicating with ink chambers.

The first object indicated above may be achieved according to a first aspect of this invention, which provides a method of manufacturing an ink jet head including an ink-chamber member having a plurality of ink chambers to be filled with an ink, and a nozzle plate which is secured to a front end face of the ink-chamber member and which has a plurality of ink-jet holes communicating with the plurality of ink chambers, respectively, the method comprising the steps of: (a) forming by injection molding a blank for the nozzle plate, the blank having a plurality of blind holes formed in one of opposite surfaces thereof which corresponds to a surface of the nozzle plate at which the nozzle plate is secured to the front end face of the ink-chamber member, the blank having bottom walls defining bottoms of the blind holes, respectively, each of the blind holes having a varying-area portion whose cross sectional area decreases in a direction from the above-indicated one of opposite surfaces toward the bottom of the blind hole; (b) laser-cutting the blank to remove at least a portion of each of the bottom walls and thereby form a plurality of orifice holes which cooperate with the blind holes to form the ink-jet holes, whereby the nozzle plate is prepared; and (c) securing the blank to the front end face of the ink-chamber member before the blank is laser-cut, or securing the nozzle plate to the front end face of the ink-chamber member after the nozzle plate is prepared by laser-cutting the blank.

In the method of the present invention described above, the blank for the nozzle plate is formed by injection molding such that the blank has the blind holes each having the varying-area portion whose cross sectional area decreases toward the bottom of the blind hole. The bottom wall defining the bottom of each blind hole is at least partially removed by a laser-cutting process so as to form the orifice hole which cooperates with the blind hole to constitute the ink-jet hole. Thus, the nozzle plate having the ink-jet holes each including the orifice hole portion and the varying-area portion is prepared. The present method permits each ink-jet hole to have a sufficiently large volume, and eliminates the drawback of the conventional method, that is, prevents undesirable formation of burrs around the edge of the ink outlet opening of the orifice hole portions of the ink-jet holes or within the ink-jet holes.

Further, the present method of manufacturing the ink jet head makes it possible to form the ink-jet holes with a sufficiently large volume so as to prevent entry of air into the ink-jet holes while minimizing the amount of energy required for jetting the ink from the ink-jet holes, whereby the quality of images formed by the ink jet head can be significantly improved without an increase in the energy cost. Moreover, the present method permits easy shaping of the ink-jet holes so as to assure smooth flows of the ink from the ink chambers into the ink-jet holes with a reduced flow resistance. It is also noted that the absence of the burrs left around the edge of the outlet opening of the orifice holes (orifice hole portions of the ink-jet holes) assures freedom of the ink droplets from flying off the nominal line of path leading the right spots on the recording medium. In this respect, too, the quality of the images formed by the ink jet head can be improved.

The second object indicated above may be achieved according one form of the invention, wherein the blind holes are formed in the blank such that the size of each blind hole as measured at an open end thereof is smaller than the size of the corresponding ink chamber as measured at an open end thereof at which the ink chamber communicates with the corresponding ink-jet hole. This arrangement is effective to minimize a problem which would take place when the nozzle plate and the ink-chamber member would not be aligned with each other with high accuracy. Described more specifically, the present arrangement is effective to reduce or zero the ratio of the ink-jet holes having shoulder surfaces facing the ink outlet opening of the orifice holes, which shoulder surfaces are formed at the interface of the nozzle plate and the ink-chamber member, so as to face the ink outlet opening of the orifice holes. Since the ratio of the ink-jet holes having such shoulder surfaces is zeroed or minimized, the present form of the invention is effective to eliminate or minimize the possibility that air bubbles are left within the ink-jet holes due to the shoulder surfaces, whereby the yield ratio of the ink jet head manufactured by the present method is increased.

In one arrangement of this form of the invention, a difference between the sizes of the blind holes and the ink chambers as measured at the open ends indicated above is determined depending upon a desired tolerance of misalignment of the nozzle plate with respect to the ink-chamber member when the nozzle plate is secured to the ink-chamber member.

To increase the yield ratio of the ink jet head, namely, the ratio of acceptance of the products manufactured by the present method, the size difference indicated above is preferably at least 4 μm, more preferably at least 8 μm, and most preferably at least 12 μm.

From the standpoint of the yield ratio of the ink jet head, it is desirable to determine the size difference of the blind holes and the ink chambers so that any blind hole does not have the above-indicated shoulder surface facing the ink outlet opening of the orifice hole, even if the amount of misalignment of the ink-jet hole and the ink chamber is an expected maximum. To maximize the volume of each ink-jet hole and assure a smooth flow of the ink from the ink chamber into the ink-jet hole, on the other hand, it is desirable to minimize the size difference of the blind holes and the ink chambers. In this sense, it is ideal to minimize the actual amount of misalignment of the nozzle plate and the ink-chamber member, and determine the size difference so as to avoid the shoulder surfaces facing the outlet opening of the orifice holes even if the actual misalignment amount is the expected maximum. Where the situation does not permit sufficiently accurate alignment of the nozzle plate with respect to the ink-chamber member, however, the size difference has to be determined to assure relatively smooth flows of the ink into the ink-jet holes, at the sacrifice of allowing some of the ink-jet holes to have such shoulder surfaces.

According to another form of this invention, the blank is laser-cut such that the bottom walls defining the bottoms of the blind holes are irradiated by a laser beam which is incident upon the bottom of each blind hole through the open end of the blind hole. The ink-jet holes thus formed by laser-cutting are suitably shaped for intended jetting of the ink. While the orifice hole of each ink-jet hole is formed by removal of the bottom wall with a laser beam, this orifice hole cannot have a strictly uniform cross sectional area over its entire length. In other words, the cross sectional area of the orifice hole tends to decrease in the direction of propagation of the laser beam, that is, in the direction from the varying-area portion of the blind hole toward the ink outlet end of the orifice hole.

If the diameter of the laser beam is smaller than that of the bottom wall of the blind hole, a shoulder surface facing the ink chamber is formed within the ink-jet hole (at the inner end of the orifice hole), and the radially inner edge portion of this shoulder surface tends to be rounded by the laser beam. Therefore, if the bottom walls of the blind holes were irradiated with laser beams incident upon the surface of the nozzle plate blank opposite to the its surface in which the blind holes are formed, the cross sectional area of the orifice hole formed by the laser beam tends to increase in the direction from its inner end to its ink outlet outer end, and the inner edge of the ink outlet outer end tends to be rounded. Experiments showed that the ink jetting from the ink-jet hole formed by the laser beam incident through the open end of the blind hole is desirable than that from the ink-jet hole formed by the laser beam incident upon the surface of the blank opposite to the surface in which the blind hole is open.

According to the above form of the invention, each ink-jet hole can be formed with a cross sectional area which generally decreases in the direction from the ink chamber toward the ink outlet end of the orifice hole, or which does not increase in that direction at any portion of the ink-jet hole. Further, the inner edge of the ink outlet end of the ink-jet hole is prevented from being rounded by the laser beam.

The bottom walls of the blank can be suitably removed by exposure to excimer laser. The use of excimer laser permits efficient formation of the orifice hole by removal of at least a portion of the bottom wall (which defines the bottom of the blind hole), with high dimensional accuracy and high accuracy of position relative to the blind-hole.

The bottom walls of the blank may be irradiated with respective laser beams, simultaneously or one after another. In either case, the bottom walls defining the bottoms of the blind holes may be entirely or partially removed, depending upon the cross sectional size and shape of the laser beams. If each bottom wall is partially removed, the cross sectional shape of the orifice hole formed may be similar to or different from that of the bottom wall. For instance, a circular or rectangular orifice hole may be formed while the cross sectional shape of the bottom wall is rectangular corresponding to a rectangular cross sectional shape of projections which are provided in the injection mold to form the blind holes. Preferably, the orifice hole has a circular cross sectional shape, for improved ink jetting characteristics of the ink jet head. Where the bottom walls of the blank are irradiated one after another or sequentially by a laser beam, the required output of the laser is smaller than that where the bottom walls are simultaneously irradiated with respective laser beams. Consequently, an inexpensive laser generator having a relatively small capacity may be used, whereby the cost of the equipment to manufacture the blank for the nozzle plate is lowered.

Alternatively, two or more or all of the bottom walls may be irradiated simultaneously with a single laser beam having a cross sectional area which covers an area of the blank in which the bottom walls to be irradiated are located. In this case, a mask for irradiating the bottom walls with respective local laser beams may be eliminated. If the cross sectional area or size of the laser beam does not cover all of the bottom walls, the irradiation is repeated with the axis of the laser beam being shifted to cover another area of the blank. The simultaneous irradiation of the bottom walls with a single laser beam is preferable for increased efficiency of manufacture of the ink jet head. According to this arrangement, the third object indicated above can be achieved.

The fourth object indicated above may be achieved according to a further form of this invention, wherein the blind holes are formed in two or more rows in the blank. This arrangement is effective to increase the density of the ink-yet holes. In this case, the blank is desirably formed by using an injection mold which includes a plurality of cores corresponding to the rows of the blind holes, respectively, each core having a row of projections for forming the corresponding row of the blind holes. With the cores suitably positioned relative to each other, the blind holes in one row may be easily offset in the direction of the row from those in another row, by a half or smaller portion of the pitch of the blind holes of each row. Thus, the cost for preparing the blank can be reduced.

When the two or more cores are used as indicated above, it is desirable that the individual cores have respective ribs, so that when the blank is injection-molded with these cores butted together so as to form an end surface from which the projections and ribs extend, the ribs cooperate to form a recess in the surface of the blank in which the blind holes are open. While some amount of burr is left at the interface of the contacting surfaces of the adjacent cores, the recess formed by the ribs accommodates the burr, and the burr will not prevent the surface of the nozzle plate from closely contacting the front end face of the ink-chamber member. Thus, it is not necessary to remove the burr when the nozzle plate prepared from the blank is secured to the ink-chamber member, whereby the cost of manufacture is accordingly reduced.

Where the two or more cores are used in the injection mold to form the blank having the blind holes in two ore more rows, it is desirable that a portion of the surface of the blank which corresponds to the interface of the cores be irradiated with a laser beam, to remove a burr left at that portion of the surface of the blank. When the ribs are provided on the cores to form the recess, the burr left in the recess may be removed by this irradiation with the laser beam. However, the irradiation eliminates the provision of the recess, i.e., the provision of the ribs on the cores of the injection mold.

According to an advantageous arrangement of this invention, the bottom walls of the blind holes are irradiated with a laser beam which is incident upon the bottom of each blind hole through an open end of the blind hole, and the laser beam has a cross sectional area larger than that of the bottom of each blind hole. According to this arrangement, the bottom wall defining the bottom of each blind holes is removed over the entire area of the bottom. Although the inner surface of the varying-area portion of the blind hole, namely, the inclinded surface of the blind hole is also exposed to the laser beam, substantially no amount of stock is removed from the inner surface defining the varying-area portion, because the energy density of the laser beam at this inner surface is small since the axis of the laser beam is not normal or at right angle to the inclinded surface. Accordingly, the position and dimensions of the orifice hole formed as a result of the laser irradiation are determined solely by the position and dimensions of the blind holes, which in turn are determined by the dimensional accuracy of the injection mold used for injection molding of the blank. Since the injection mold can be comparatively easily produced with high dimensional accuracy, it is easy to form the orifice hole with sufficiently high positional and dimensional accuracies.

According to another advantageous arrangement of this invention, the bottom walls of the blind holes are irradiated with a laser beam which has a circular cross sectional shape and a cross sectional area smaller than the area of the bottom of each blind hole. In this case, only a central portion of the bottom wall is removed to form a circular orifice hole. Experiments confirmed that the ink jet head exhibited excellent ink jetting characteristics where the cross sectional shape of the ink-jet hole (orifice hole) at its ink outlet end is circular.

In the above arrangement, a shoulder surface facing the ink chamber is formed at the inner end of the orifice hole formed. Since this shoulder surface faces the ink chamber, air bubbles are unlikely to be left within the ink-jet holes during operation of the ink yet head, and would not give an adverse influence on the ink jetting performance of the ink jet head unless the area of the shoulder surface is considerably large.

The above arrangement is applicable irrespective of whether the laser beam is incident upon the bottom wall of the blind hole through the open end of the blind hole, or incident upon the surface of the blank opposite to the surface in which the blind holes are open. However, this arrangement is preferably applicable when the blank is laser-cut after the blank is secured to the ink-chamber member. If the bottoms of the blind holes are exposed to the laser beam incident through the open end of the blind holes after the blank is attached to the ink-chamber member, the ink-chamber member should be designed so as to allow the laser beam to pass through the ink chambers before the laser beam is incident upon the bottom surface-of each blind hole. To this end, for instance, the ink chambers should be defined by two or more separate members which are fixed to each other. For example, a member defining the rear end portion (e.g., rear end portion of the grooves 8 and the shallow grooves 16 in the conventional ink jet head 1 of FIG. 14) of the ink chambers remote from the nozzle plate should be made independently of the ink-chamber member and subsequently attached to the ink-chamber member. In this respect, it is noted that such a member defining the rear end portion of the ink chambers may be formed as an integral part of a member (e.g., cover plate 3) which has an ink inlet and a manifold (e.g., inlet 21 and manifold 22) and which is bonded to the ink-chamber member.

According to a further advantageous arrangement of the invention, the varying-area portion of each blind hole is formed with a constant width dimension and a height dimension which decreases in the direction toward the bottom of the blind hole. This arrangement facilitates the formation of the ink chambers and the ink-jet holes at a relatively small pitch, with a sufficiently large volume of the ink-jet holes.

It is to be understood that the terms "width dimension" and "height dimension" are interpreted to mean the dimensions which are parallel and perpendicular to the direction in which the blind holes (ink-jet holes) are spaced from each other. The width and height dimensions should not be construed to determine the posture or orientation of the ink jet head in operation. It is noted that the ink jet head may be oriented such that the row of the ink-jet holes extends in the vertical direction or such that the surface of the nozzle plate in which the orifice holes are open faces down.

According to a still further advantageous arrangement of this invention, the bottom walls defining the bottoms of the blind holes have a thickness of 30–200 μm. This arrangement enjoys both easy preparation of the nozzle plate blank by injection molding, and easy removal of the bottom walls of the blank to form the orifice holes by laser-cutting. If the thickness of the bottom walls of the blind holes is excessively small, a clearance between the top face of the projections of the mold for forming the blind holes and the surface of the mold facing that top face is too small to assure adequate filling of the clearance with the material for the blank, leading to difficulty of injection molding the blank. If the thickness of the bottom walls is excessively large, on the other hand, the blank may be relatively easily injection-molded, but requires a relatively long time to remove the bottom walls by laser-cutting. The thickness range indicated above provides a compromise between the ease of injection molding and the efficiency of removal of the bottom walls to form the orifice holes.

According to a yet further advantageous arrangement of this invention, each blind hole has an open end whose height is larger than a width thereof, and the blank or nozzle plate is secured to the front end face of the ink-chamber member, in the following steps: providing one of the blank or nozzle plate and the ink-chamber member with a positioning extension; positioning the blank or nozzle plate with respect to the ink-chamber member, in a direction of the height of the open end of the blind hole, by engagement of the positioning extension with the other of the blank or nozzle plate and the ink-chamber member; and positioning the blank or nozzle plate with respect to the ink-chamber member, in a direction of the width of the open end of the blind hole, by detecting and adjusting a relative position of the blank or nozzle plate and the ink-chamber member in the direction of the width of the open end of the blind hole.

The above manner of securing the blank or nozzle plate to the ink-chamber member does not require detection and adjustment of the relative position of the blank or nozzle plate and the ink-chamber member in the direction of the height of the open end of the blind holes. Accordingly, the blank or nozzle plate can be easily secured to the ink-chamber member with high positioning accuracy.

According to another advantageous arrangement of the present invention, each of the blind holes consists entirely of the varying-area portion. This configuration of the blind hole facilitates the removal of the nozzle plate blank from the injection mold, and assures smooth flows of the ink through the ink-jet holes formed through the nozzle plate prepared. However, each blind hole may consist of the varying-area portion, and one or two constant-area portions. One constant-area portion may be provided adjacent to the small end or large end of the varying-area portion, or two constant-area portions may be provided adjacent to the small and large ends of the varying-area portion.

According to a further advantageous arrangement of the invention, the varying-area portion of each blind hole has a cross sectional shape that causes a decrease in a rate of decrease in the cross sectional area in the direction toward the bottom. This shape of the varying-area portion also permits smooth flows of the ink through the ink-jet holes. If the varying-area portion is tapered so that the cross sectional area decreases linearly, an edge portion is formed at the connection of the orifice hole and the varying-area portion (or constant-area portion adjacent to the small end of the varying-area portion). This edge portion disturbs the ink flow. The present arrangement results in smooth continuity of the varying-area portion into the orifice portion, and may eliminate the edge portion between the orifice hole and the varying-area portion if the rate of decrease in the cross sectional area is zeroed near the bottom of the blind hole.

According to another aspect of this invention, there is provided a method of manufacturing an ink jet head having a plurality of ink chambers to be filed with an ink, and a plurality of ink-jet holes which are formed through a front end wall and which communicate with the plurality of ink chambers, respectively, the method comprising the steps of: forming a plurality of blind holes in the front end wall of the ink jet head such that the blind holes are open in one of opposite surfaces of the front end wall on the side of the ink chambers and communicate with said ink chambers, respectively, each of said blind holes having a varying-area portion whose cross sectional area decreases in a direction from the above-indicated one of opposite surfaces of the front end wall toward the other of the opposite surfaces; and irradiating simultaneously bottoms of at least a plurality of the blind holes with a single laser beam, so as to form orifice holes which communicate with the corresponding blind holes. The cross sectional size or area of the single laser beam should cover an area of the blank in which the bottom walls to be irradiated are located.

To increase the efficiency of production of the ink jet head, it is desirable to simultaneously expose to the laser beam the bottoms of all the blind holes formed in the front end wall of the ink jet head. However, where the capacity of the laser beam is not sufficient for simultaneous irradiation for all the blind holes, the blind holes are divided into two or more groups, and the bottoms of the blind holes of each group are concurrently irradiated with the laser beam.

The front end wall of the ink jet head may be formed integrally with the ink-chamber portion having the ink chambers, or may be prepared as a separate member which is secured to the front end face of the ink-chamber portion of the head.

The fifth object indicated may be achieved according to a further aspect of the present invention, which provides an ink jet head including an ink-chamber member having a plurality of ink chambers to be filled with an ink, and a nozzle plate which is secured to a front end face of the ink-chamber member and which has a plurality of ink-jet holes communicating with the plurality of ink chambers, respectively, wherein each of the ink-jet holes includes a varying-area portion whose cross sectional area decreases in a direction from one of opposite surfaces of the nozzle plate at which the nozzle plate is secured to the front end face of the ink-chamber member toward the other of the opposite surfaces, and further includes an orifice portion which communicates at one of opposite ends thereof with the varying-area portion and is open at the other of the opposite ends in the other of the opposite surfaces of the nozzle plate, and wherein the varying-area portion of each blind hole is formed during preparation of the nozzle plate by injection molding, while the orifice portion is formed by laser-cutting to remove at least a portion of a bottom wall defining the each blind hole.

The fifth object may also be achieved according to a still further aspect of this invention, which provides an ink jet head including an ink-chamber member having a plurality of ink chambers to be filled with an ink, and a nozzle plate which is secured to a front end face of the ink-chamber member and which has a plurality of ink-jet holes communicating with the plurality of ink chambers, respectively, the ink jet head being characterized in that a size of each of the blind holes at an open end thereof is smaller than a size of the corresponding ink chamber at an end thereof at which the ink chamber communicates with the corresponding ink-jet hole.

BRIEF DESCRIPTION OF THE DRAWINGS

The above and other objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
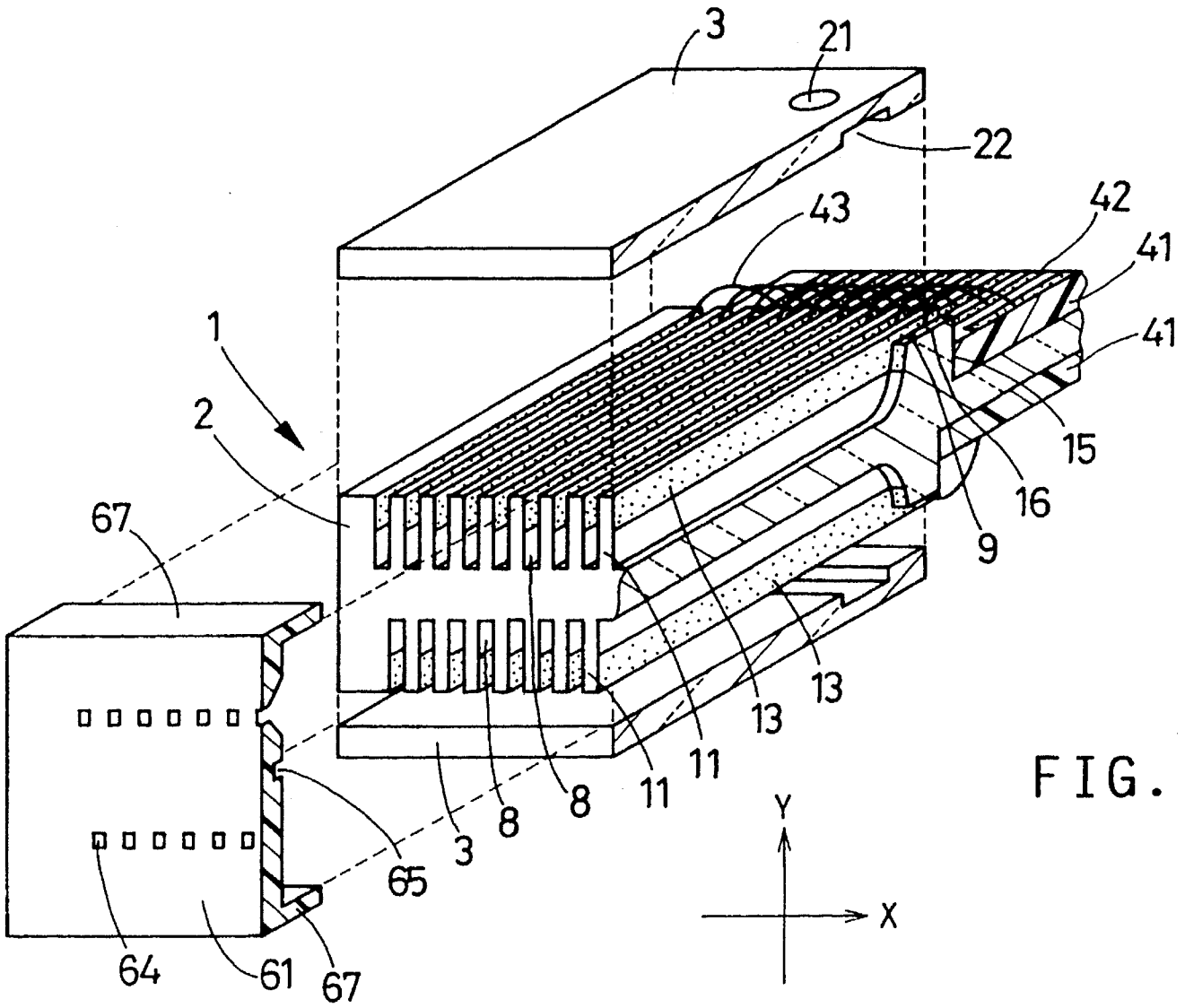
FIG. 1 is a schematic perspective view showing a construction of an ink jet head manufactured by a method according to one embodiment of the present invention.
Figure 14:
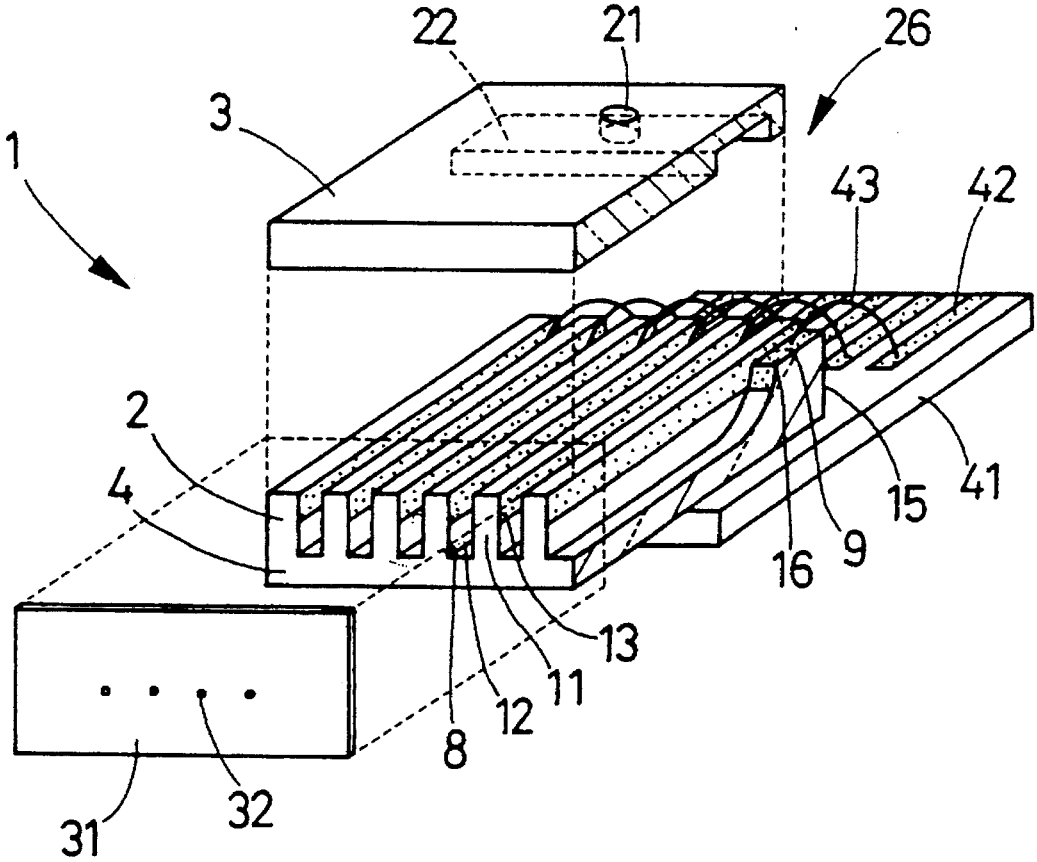
FIG. 14 PRIOR ART
FIG. 14 is a perspective view showing a known ink jet head.
Figure 15:
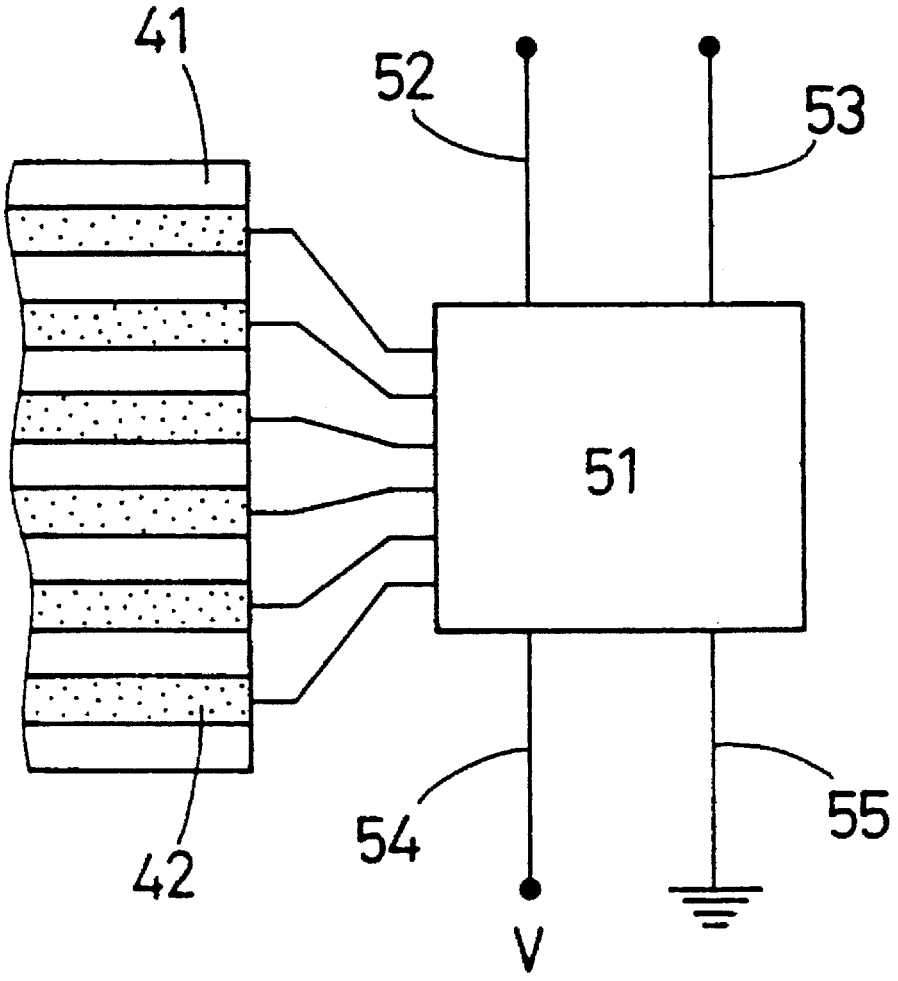
FIG. 15 PRIOR ART
FIG. 15 is a schematic view illustrating a control portion of the ink jet head of FIG. 14.

Referring first to FIG. 1, there is shown an ink jet head 1 manufactured by a method according to the first embodiment of the invention. In FIG. 1, the same reference numerals as used in FIG. 14 are used to identify the identical or equivalent elements. In the interest of brevity and simplification, redundant description of these elements of the present ink jet head will not be provided herein.

The ink jet head 1 has a piezoelectric ceramic plate 2, two cover plates 3, a nozzle plate 61 and two substrates 41.

Figure 16:
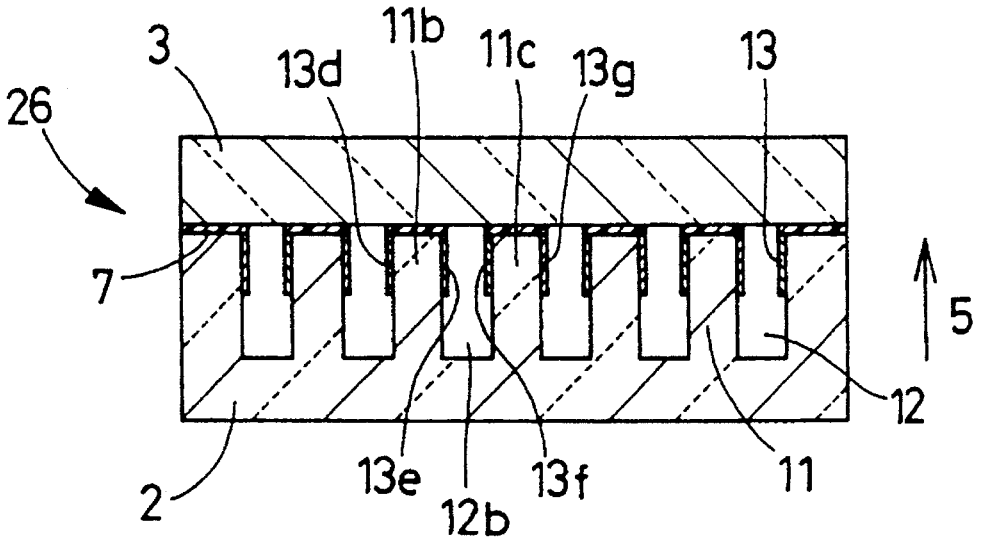
FIG. 16 PRIOR ART
FIG. 16 is a cross sectional view of the ink jet head of FIG. 14.
Figure 17:
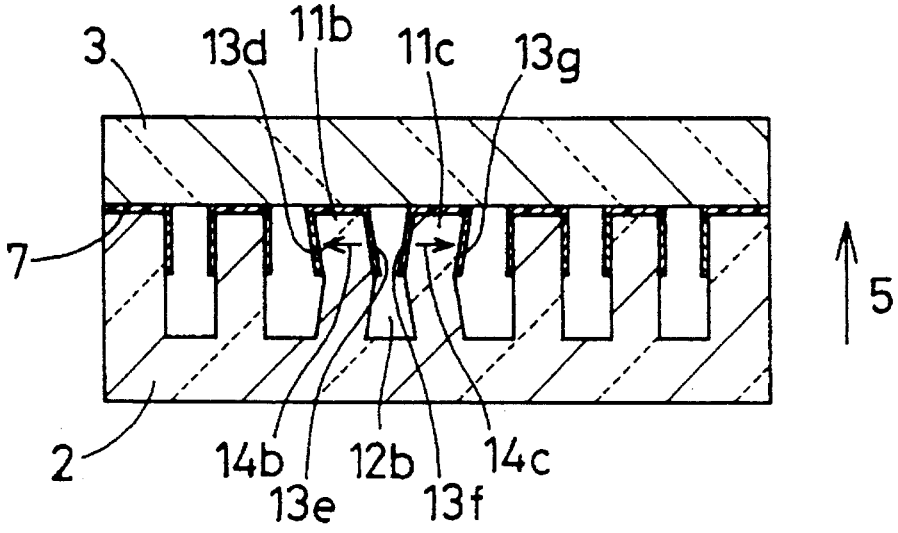
FIG. 17 PRIOR ART
FIG. 17 is a cross sectional view for explaining an operation of the ink jet head of FIG. 14.
Figure 18:
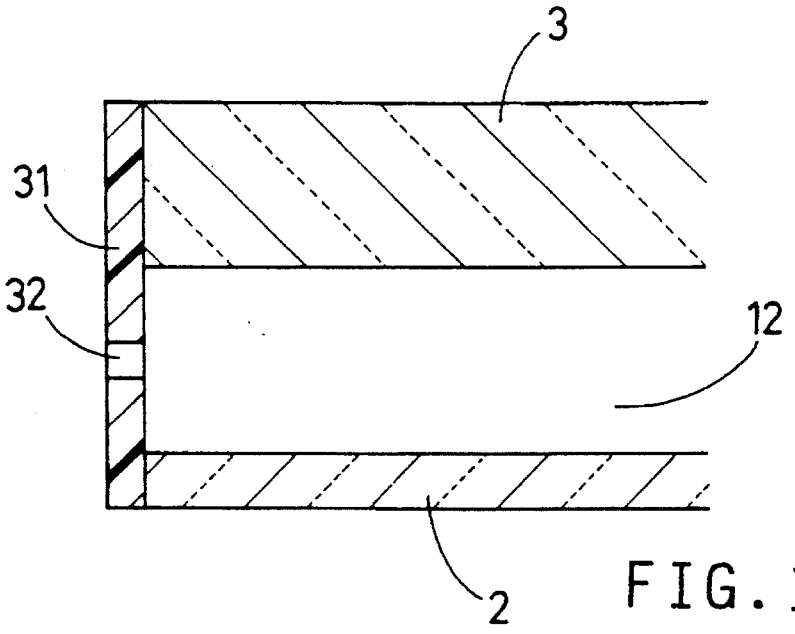
FIG. 18 PRIOR ART
FIG. 18 is a cross sectional view illustrating another known ink jet head.

The piezoelectric ceramic plate 2 is polarized as described above with respect to the ink jet head of FIG. 14, in the direction indicated by an arrow 5 in FIG. 16. The polarized plate 2 is machined at its upper and lower major surfaces, by a diamond disk blade, for example, to form respective two arrays of grooves 8. The grooves 8 of each array are defined by parallel partition walls 11, and spaced apart from each other by the partition walls 11 in the direction perpendicular to the direction of extension of the partition walls 8. The grooves 8 (partition walls 11) of the upper array are offset from the grooves 8 of the lower array by a half of the pitch of the grooves 8, in the direction in which the grooves 8 are spaced from each other. Each groove 8 has a depth of 485 μm and a width of 85 μm (in the direction perpendicular to the direction of extension of the groove 8), while each partition wall 11 has a width of 85 μm (in the direction perpendicular to the direction of extension of the wall 11).

The upper and lower arrays of the parallel grooves 8 are covered by the respective upper and lower cover plates 3, each of which is substantially identical with the cover plate 3 of FIG. 14. The electrodes 13 formed for the upper and lower arrays of the partition strips 11 are connected to respective arrays of conductive strips 42 formed on the respective upper and lower substrates 41, as described above with respect to the ink jet head shown in FIG. 14.

Figure 2:
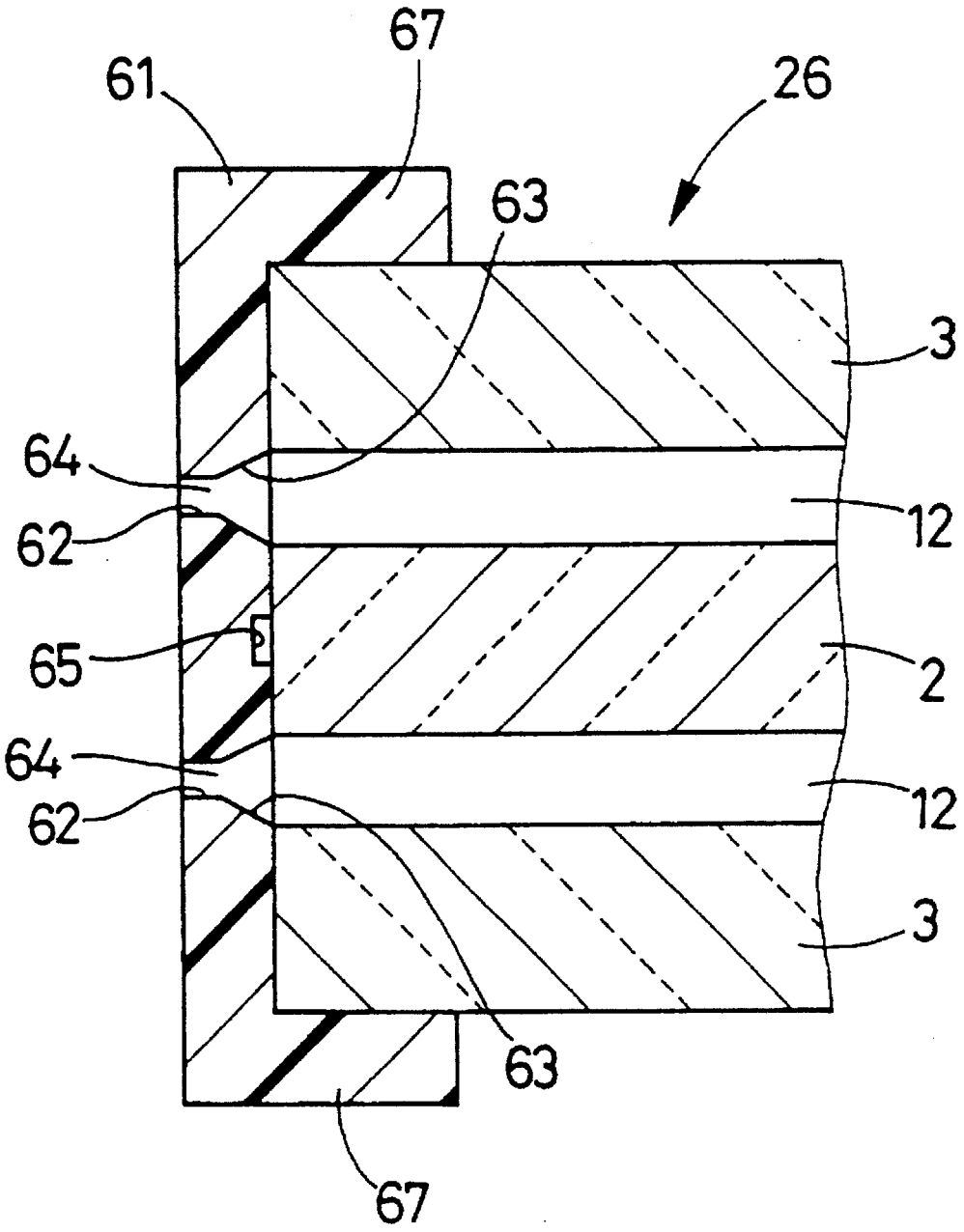
FIG. 2 is a cross sectional view of a front end portion of the ink jet head of FIG. 1.

The cover plates 3 are bonded by an epoxy resin adhesive to the upper and lower major surfaces of the piezoelectric ceramic plate 2, as shown in FIG. 2, whereby an ink-chamber member 26 is formed. The ink-chamber member 26 has two arrays of parallel ink chambers 12, which correspond to the upper and lower arrays of the grooves 8. To the front end face of the ink-chamber member 26, there is bonded the nozzle plate 61 by an epoxy resin adhesive. The nozzle plate 64 has two rows of ink-jet holes 64 corresponding to the two arrays of the ink chambers 12. The ink-jet holes 64 of each row communicate with the corresponding ink chambers 12.

For example, the ink jet head 1 is used as an ink jet print head which operates to effect dot-matrix printing on a recording medium such that the recording medium is fed relative to the print head 1. Generally, the recording medium is fed in a direction perpendicular to the direction of the rows of the ink-jet holes 64. The print head 1 may take various postures depending upon the type of a printer using the print head. For instance, the print head 1 is oriented such that the nozzle plate 1 has a vertical or horizontal posture.

Each ink-jet hole 64 consists of a tapered portion 63 communicating with the corresponding ink chamber 12, and a straight orifice portion 62 communicating with the tapered portion 63. The width dimension of the tapered portion 63 as measured in the direction of the row of the ink-jet holes 64 as seen in FIG. 1 is constant in the direction perpendicular to the direction of the row. On the other hand, the height dimension of the tapered portion 63 linearly decreases in the direction from the ink chamber 12 toward the orifice portion 62, that is, in the direction from the inner surface of the nozzle plate 61 in which the tapered portion 63 is open, toward the outer surface in which the orifice portion 62 is open, as shown in FIG. 2. The orifice portion 62 serves as an orifice hole from which an ink flowing from the ink chamber 12 is delivered, while the tapered portion 63 serves as a varying-area portion connecting the ink chamber 12 and the orifice hole. The cross sectional area of the varying-area portion decreases in the direction from the ink chamber 12 toward the orifice portion 62, as shown in FIG. 2.

The orifice portion 62 has a width dimension of 60 μm and a height dimension of 60 μm, while the tapered portion 63 has the same width and height dimensions (60 μm) as the orifice portion 62 at its small end on the side of the orifice portion 62, and the same width dimension (60 μm) as the orifice portion 62 at its large end on the side of the ink chamber 12. However, the height dimension of the tapered portion 63 at its large end is 400 μm. The ink chamber 12 has a width dimension of 85 μm and a height dimension of 485 μm at its end (hereinafter referred to as "ink outlet end") on the side of the ink-jet hole 64. Therefore, the width and height dimensions of the ink-jet hole 64 at its end (hereinafter referred to as "ink inlet end") on the side of the ink chamber 12 are smaller than those of the ink chamber 12 by 25 μm and 85 μm, respectively.

The nozzle plate 61 has a pair of positioning extensions 67 for positioning the nozzle plate 61 with respect to the ink-chamber member 26, in the direction Y indicated in FIG. 1, namely, in the direction of height of the tapered portion 63 of the ink-jet hole 64. When the nozzle plate 61 is bonded to the ink-chamber member 26, the positioning extensions 67 are held in engagement with the upper and lower surfaces of the upper and lower cover plates 3, as indicated in FIG. 2. The nozzle plate 61 further has a recess 65 formed in its surface at which the nozzle plate 61 is bonded to the ink-chamber member 26. The recess 65 extends in the direction of the rows of the ink-jet holes 64, and is aligned with the center of thickness of the piezoelectric ceramic plate 2 of the ink-chamber member 26.

The present method of manufacturing the ink jet head is characterized by the processes in which the nozzle plate 61 is prepared and attached or bonded to the ink-chamber member 26, as described below in detail.

There will first be described the manner in which the nozzle plate 61 is prepared.

Figure 5A:
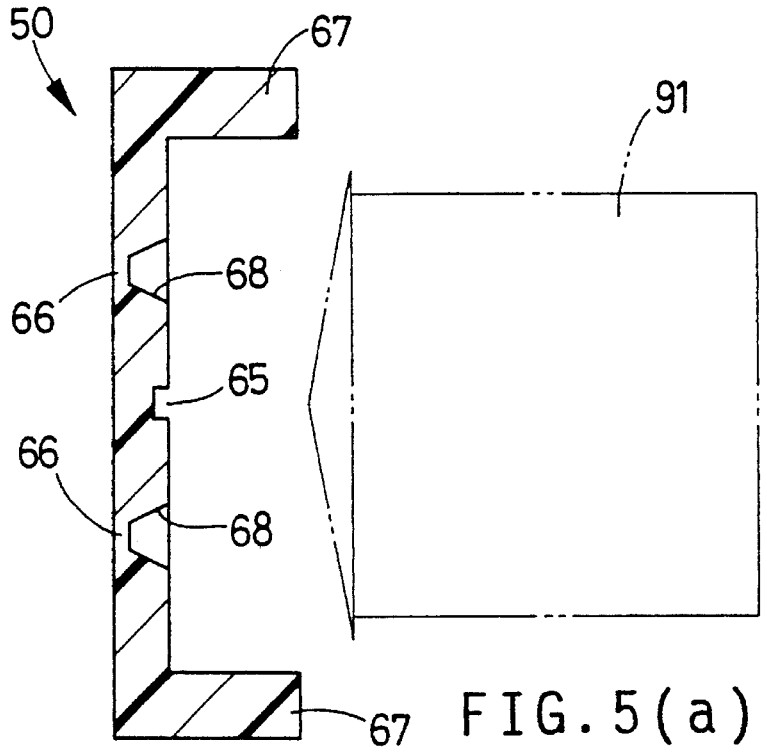
FIGS. 5(*a*) and 5(*b*) are cross sectional views of the blank which is laser-cut to produce the nozzle plate.
Figure 5B:
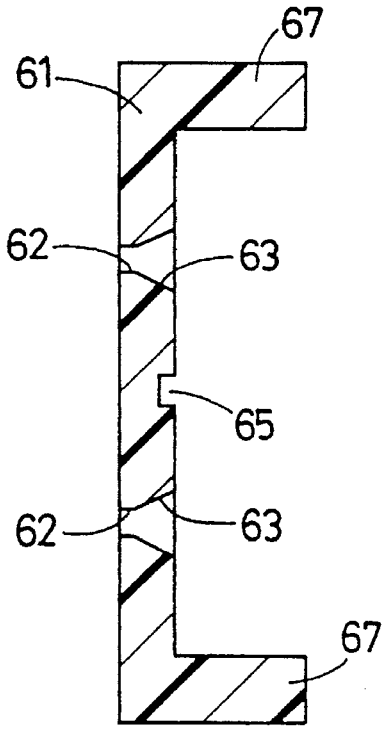

The nozzle plate 61 is prepared by first forming a blank 50 by injection molding, and then forming the straight orifice portion or orifice hole 62 by a laser-cutting technique. As shown in FIG. 5(*a*), the blank 50 has two rows of blind holes 68 which provide the two rows of the tapered portions (varying-area portions) 63 described above, and the recess 65 also described above. However, the blank 50 does not have the straight orifice portions (orifice holes) 62. The blank 50 is formed of polyphenylene sulfide, by using an injection mold as schematically shown in FIGS. 3(*a*) and 3(*b*).

Figure 3A:
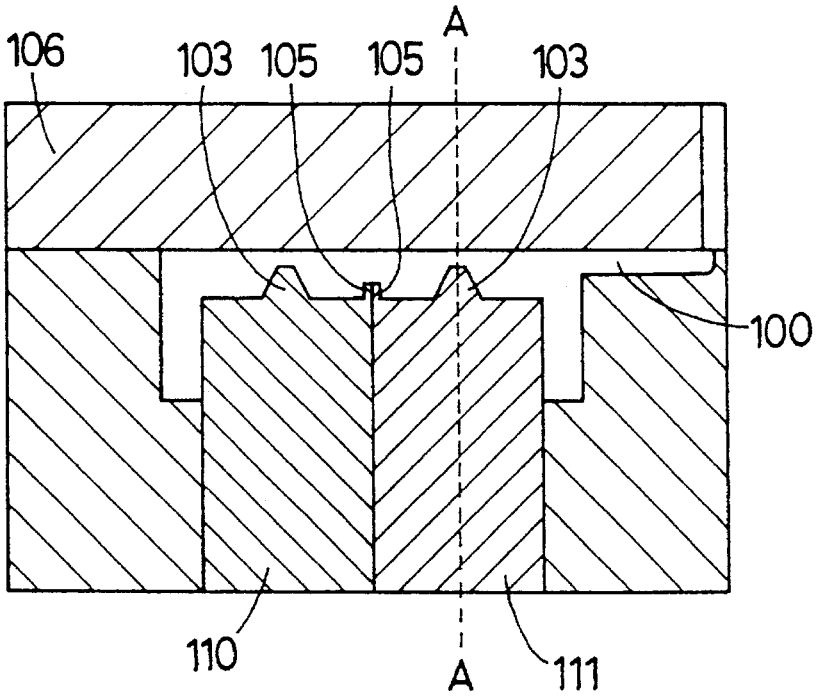
FIGS. 3(*a*) and 3(*b*) are cross sectional views showing an injection mold used for forming a blank used for producing a nozzle plate of the ink jet head of FIG. 1.
Figure 3B:
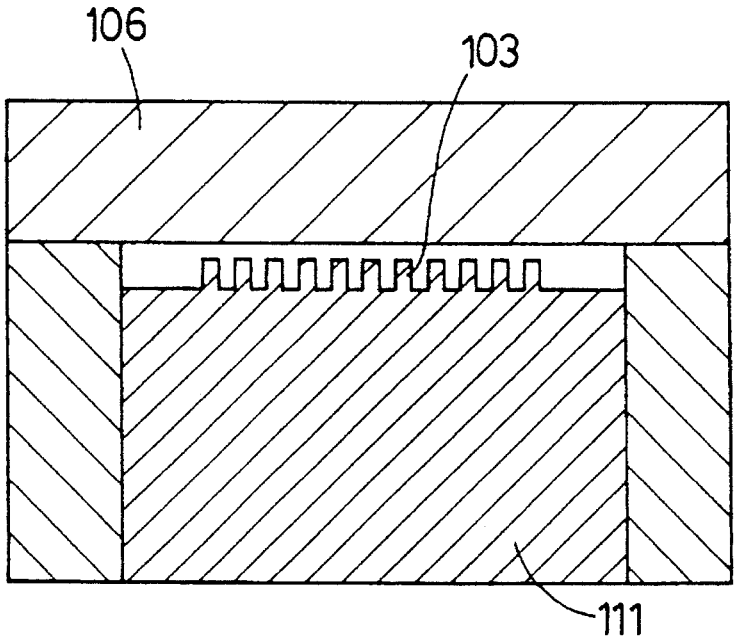
Figure 4:
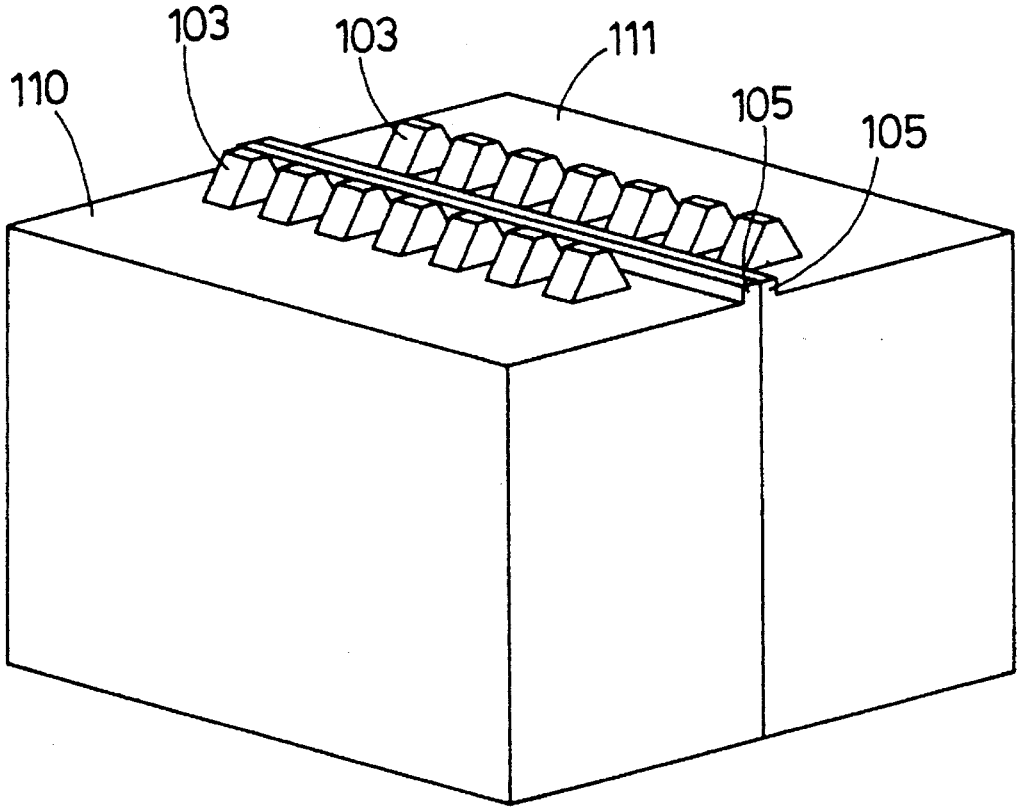
FIG. 4 is a perspective view of two cores used in the injection mold of FIGS. 3(*a*) and 3(*b*)

The injection mold includes a top plate 106, and two cores 110, 111 disposed below the top plate 106, as shown in FIGS. 3(*a*) and 3(*b*). The two cores 110, 111 are butted together so as to form an end surface which cooperates with the lower surface of the top plate 106 to define the thickness of the blank 50. As shown in FIG. 4 in detail, the cores 110, 111 have respective rows of tapered projections 103 and respective ribs 105 which are formed so as to extend from the end surface indicated above. The tapered projections 103 are shaped to form the two rows of blind holes 68, while the ribs 105 are shaped to form the recess 65. Each tapered projection 103 has a predetermined thickness dimension as seen in FIG. 3(*b*) which corresponds to the width dimension (60 μm) of the blind hole 68 (tapered or varying-area portion 63), and a width dimension which linearly decreases in the direction from the bottom toward the top as seen in FIG. 3(*a*). Namely, each tapered projection 103 has a trapezoid shape in cross section as seen in FIG. 3(*a*). This shape corresponds to the cross sectional shape of the blind hole 68 as seen in FIG. 5(*a*).

To form the blank 50 by injection molding using the mold of FIGS. 3 and 4, the material is introduced into the mold cavity through a gate 100. As a result, the blank 50 having the blind holes 68 in two rows is prepared. The blind holes 68 give the tapered portions 63 of the ink-jet holes 64 of the nozzle plate 61. As shown in FIG. 5(*a*), the depth or bottom of each blind hole 68 is defined by a bottom wall 66 having a relatively small thickness, which is determined by a clearance between the lower surface of the top plate 106 and the top surface of the tapered projection 103. Thus, the blank 50 has the bottom walls 66 in two rows corresponding to the two rows of the blind holes 68.

The two cores 110, 111 are butted together such that the tapered projections 103 provided on one of the cores are offset from those provided on the other core, by a distance equal to a half of the pitch of the ink-jet holes 64 (pitch of the projections 103 or blind holes 68, in the direction of the rows of the projections 103. In this respect, it is noted that it is difficult to form one-piece core having the two rows of tapered projections 103 which are offset from each other. Explained more specifically, each core 110, 111 is produced by first preparing a blank which has an elongate protrusion having a trapezoid cross sectional shape (identical with that of the tapered projections 103 as seen in FIG. 3(*a*)). This elongate protrusion may be formed by machining, grinding, wire-cutting or other suitable operation. Then, the elongate protrusion on the blank is subjected to a cutting operation with a suitable tool such as a diamond blade in the form of a disk with a small thickness, to form grooves which extend across the length of the elongate protrusion and which define the tapered projections 103. If two elongate protrusions formed on a single core were subjected to such groove cutting operation by a diamond disk blade, the disk blade which is grooving on one of the two elongate protrusions would interfere with the other elongate protrusion. Since the tapered projections 103 of one row should be offset from those of the other row, the manufacture of a single core with the tapered projections 103 formed in two rows is difficult. In the light of this fact, the two separate cores 110, 111 are prepared and butted together as indicated in FIG. 4, according to the present embodiment of the invention.

The two ribs 105 indicated above are formed so as to extend along the edges of the two cores 110, 111 at which the cores are butted together. These ribs 105 cooperate to have a cross sectional shape as seen in FIG. 3(*a*), which corresponds to the cross sectional shape of the recess 65 as seen in FIG. 5(*a*).

The blank 50 formed with the cores 110, 111 having the ribs 105 has a burr left on the bottom surface of the recess 65, due to a small gap between the ribs 105. However, since the burr is accommodated within the recess 65, the burr will not disturb bonding of the nozzle plate 61 (blank 50) to the front end face of the ink-chamber member 26. In other words, the recess 65 is provided to prevent the burr from being left on the surface of the nozzle plate 61 to be bonded to the ink-chamber member 26.

The blank 50 thus prepared is subjected to a laser-cutting process using excimer laser, to produce the nozzle plate 61 as shown in FIG. 5(*b*). Described in detail, the bottom walls 66 which define the bottoms of the blind holes 68 are irradiated with excimer laser beam and thereby removed to form the orifice portions or holes 62, whereby the ink-jet holes 64 are formed.

While this laser-cutting operation may be carried out after the blank 50 is bonded to the front end face of the ink-chamber member 26, the present embodiment is adapted to perform the laser-cutting operation on the blank 50 before the blank 50 is bonded to the ink-chamber member 26. That is, the nozzle plate 61 prepared from the blank 50 by laser-cutting to form the orifice holes 62 (ink-jet holes 64) is bonded to the ink-chamber member 26. As described below, the bottom walls 66 are exposed to the laser beam such that the laser beam is incident upon the bottoms of the blind holes 68 through the open end of the blind holes 68. This laser-cutting operation is impossible after the blank 50 is bonded to the ink-chamber member 26, because the ink-chamber member 26 disturbs the propagation of the laser beam through the ink chambers 12 and toward the bottom surfaces of the bottom walls 66.

In the present embodiment, a portion of the surface of the blank 50 in which all of the blind holes 68 are open is irradiated with an excimer laser beam 91, as indicated in FIG. 5(*a*). That is, the laser beam 91 has a cross sectional area which covers all the blind holes 68. As a result, the bottom walls 66 which define the bottoms of the blind holes 68 are simultaneously removed, whereby the orifice holes 62 (orifice portions 62) are formed, as indicated in FIG. 5(*b*). Thus, the nozzle plate 61 having the ink-jet holes 64 is prepared. Each ink-jet hole 64 consists of the tapered portion 63 provided by the blind hole 68, and the orifice portion 62 provided by the orifice hole 62.

While the tapered surfaces of the tapered blind holes 68 are also exposed to the laser beam 91, substantially no material is removed from these tapered surfaces, since the amount of energy per unit area of the tapered surfaces of the blind holes 68 is considerably smaller than that of the bottom walls 66, because the direction of incidence of the laser beam 91 upon the tapered surfaces is not normal to the tapered surfaces. Generally, substantially no material is removed from the portion of the inner surface of the blank 50 which is to be bonded to the front end faces of the piezoelectric ceramic plate 2 and cover plates 3, since the laser beam 91 is focused on the bottom surfaces of the blind holes 68, and not focused on the inner surface of the blank 50. The nozzle plate blank 50 and the eximer laser are so designed.

Some amount of the material may be removed from the surface portion of the blank 50 which is to be bonded to the ceramic and cover plates 2, 3, due to fluctuation of the focus point or intensity of the laser beam 91, for example. In this event, there would be a thickness difference between the irradiated inner portion and the non-irradiated outer portion of the blank 50 (nozzle plate 61). In this event, the inner surface of the nozzle plate 61 will not closely contact the front end face of the ink-chamber member 26. To avoid this drawback, it is desirable that the cross sectional area or size of the laser beam 91 be equal to or larger than the area of the inner surface of the blank 50 which is to contact the ink-chamber member 26. In this case, the inner surface of the blank 50 is entirely irradiated with the laser beam 91, and is uniformly subjected to the laser cutting if any, whereby the nozzle plate 61 can be bonded to the ink-chamber member 26, with a close fit of the contacting surfaces.

If the inner surface of the blank 50 is subject to some amount of removal of the material when the bottom walls 66 are removed by the laser beam 91, the burr left on the bottom surface of the recess 65 is also removed. Since the burr accommodated in the recess 65 will not disturb a close-contact bonding of the nozzle plate 61 to the ink-chamber member 26 and need not be removed, it is not essential but is preferable to remove this burr if the removal of the burr can be effected during the removal of the bottom walls 66.

The burr if left on the inner surface of the blank 50 causes an undesirable gap between the bonding surfaces of the nozzle plate 61 and the ink-chamber member 26. If the burr left on the inner surface of the blank 50 can be removed during the laser-cutting operation to form the orifice holes 62 by removal of the bottom walls 66, it is not necessary to form the recess 65, and therefore not necessary to form the ribs 105 on the cores 110, 111. In this case, the cores 110, 111 can be formed with ease, and the blank 50 can be prepared without a risk of buckling or flexure in the presence of the recess 65.

Figure 6A:
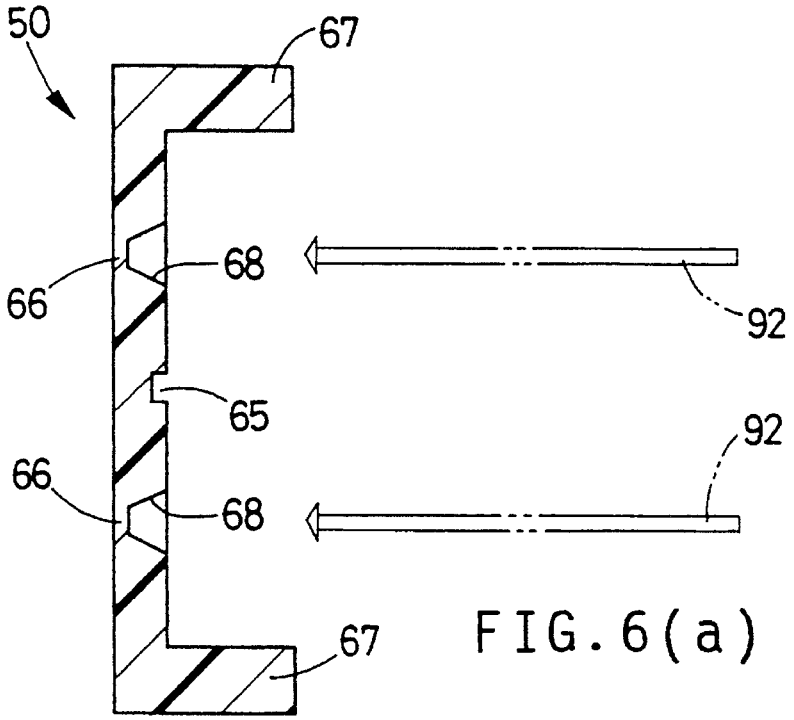
FIGS. 6(*a*) and 6(*b*) are cross sectional views of the blank which is laser-cut to produce the nozzle plate according to a second embodiment of the invention.
Figure 6B:
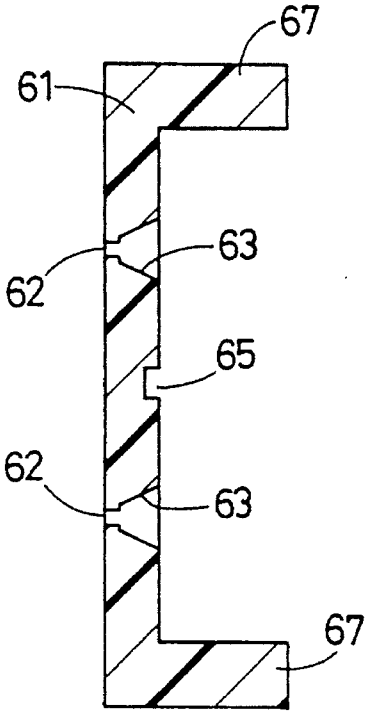

Referring next to FIGS. 6(*a*) and 6(*b*), there will be described a second embodiment of this invention, in which the blank 50 is not exposed to the single laser beam 91. In this modified embodiment, only the bottom walls 66 of the blind holes 68 are simultaneously irradiated with respective local laser beams 92, which are emitted from a mask which has a pattern of openings similar to the cross sectional shape of the orifice holes 62 to be formed.

If the cross sectional area or size of each local laser beam 92 is selected to be smaller than the cross sectional size of the blind hole 68 at its large end, and slightly larger than the cross sectional size of the blind hole 68 at its small end, the bottom wall 66 is removed by the laser beam 92 over its entire area (in the plane of the blank 50).

In the present embodiment wherein the cross sectional size of the local laser beams 92 is larger than that of the blind hole 68 at its small end, it is not necessary to accurately align the local laser beams 92 relative to the local bottom walls 66 of the blind holes 68, since the local laser beams 92 are positioned relative to each other by the openings of the mask which are similar in the cross sectional shape to the orifice holes 62, and since a relatively rough positioning of the laser beams 92 (mask) with respect to the blank 50 permits the laser beams 92 to irradiate the entire area of the bottom surfaces of the blind holes 68, in spite of some misalignment of the beams 92 with the blind holes 68. Therefore, the position accuracy of the orifice portions 62 of the ink-jet holes 64 is determined by the position accuracy of the tapered projections 103 of the cores 110, 111, which position accuracy can easily be made sufficiently high.

In the present arrangement, the cross sectional shape of the orifice holes 62 formed is rectangular at the ink outlet end. Although the orifice holes 62 whose cross sectional shape is rectangular at their ink outlet ends permit ink jetting without a trouble, a circular cross sectional shape at the ink outlet ends was found desirable. In this respect, the laser-cutting operation described above may be modified such that the laser beams 92 have a circular cross sectional shape and a cross sectional size smaller than that of the bottom surface of the blind holes 68. In this case, the orifice portions or holes 62 have a circular cross sectional shape, and a cross sectional size smaller than that of the bottom of the blind holes 68, as indicated in FIG. 6(*b*).

In the case of FIG. 6(*b*), a shoulder surface is formed at the boundary between the orifice portion 62 and the tapered portion 63 of each ink-jet hole 64. Since this shoulder surface faces the ink chamber 12, air bubbles are unlikely to stay in the ink chamber 12, and the shoulder surface does not have an adverse effect on the ink jetting performance of the ink jet head, if the area of this shoulder surface is small. Further, the shoulder surface tends to be rounded at its inner edge or periphery as a result of exposure to the laser beam 92 incident through the open end of the blind hole 68. The rounded inner edge portion of the shoulder surface acts to assure a smooth flow of the ink through the ink-jet hole 64.

The orifice portions 62 formed by removal of the bottom walls 66 by the laser beams do not have a strictly uniform cross sectional shape or size over its entire depth or length (in the direction of thickness of the nozzle plate 61). That is, the cross sectional size of each orifice portion 62 tends to decrease in the direction from the tapered portion 63 toward the ink outlet end of the orifice portion 62. However, the edge of the ink outlet end of the orifice portion 62 is not rounded by the laser beam 92.

Experiments showed excellent ink jetting characteristics of the ink-jet holes 64, particularly where the orifice portions 62 each having a circular cross sectional shape and a diameter of 50 μm are formed through the central portion of the bottom walls 66 which have a square shape of 60 μm×60 μm. For comparison with the nozzle plate 61 having these orifice portions 62, a comparative nozzle plate was prepared. While this comparative nozzle plate has similar orifice portions of 50 μm diameter, these orifice portions were formed by laser beams which were incident upon the surface of the blank opposite to the surface in which the blind holes 68 are open. In the preparation of the comparative nozzle plate, the direction of propagation of the laser beams is opposite to that in the preparation of the nozzle plate 61 as described above. Ink jetting tests were conducted on the ink jet head 1 using the nozzle plate 61 and the ink jet head using the comparative nozzle plate. The tests showed a better ink jetting result on the ink jet head 1 according to the present invention.

The better result of the ink jet head 1 having the ink-jet holes 64 according to the present invention appears to be derived from the gradual decrease of the cross sectional area of the orifice portions 62 in the direction from the tapered portions 63 toward the ink outlet end of the orifice portions 62, and also derived from the absence of the rounded edge of the orifice portions 62 at their ink outlet ends. The above gradual decrease of the cross sectional area and freedom from the edge rounding of the orifice portions 62 are considered to assure good release and straight flying of the ink droplets from the ink-jet holes 64. Further, the ink-jet holes 64 are unlikely to draw air into the tapered portions 63 when the pressure in the ink chambers 12 is lowered after the ink droplets are delivered from the ink-jet holes 64. Even if air bubbles were introduced into the ink-jet holes 64, the bubbles are easily forced out of the holes 64 upon subsequent jetting of the ink.

In the ink jet head using the comparative nozzle plate, on the other hand, the cross sectional area of the orifice portions 62 gradually increases in the direction from the ink outlet ends of the orifice portions 62 toward the tapered portions 63, and the edge of the orifice portions 62 is rounded at their ink outlet ends. Accordingly, the rear end portion of the ink droplets tends to stick to the rounded edge portion around the ink outlet openings of the orifice portions, and the ink droplets are less likely to fly straight forward from the ink-jet holes 64. Further, the ink-jet holes provided in the comparative nozzle easily draw air, and do not allow easy discharge of air bubbles once introduced therein.

Where the cross sectional area or size of the laser beams 92 is smaller than the area of the bottom walls 66 of the blind holes 68, the position accuracy of the orifice portions 62 of the ink-jet holes 64 is determined and influenced by the accuracy of positioning of the laser beams 92 relative to the blind holes 68. In this respect, it is desirable to accurately position the laser beams 92 with respect to the blank 50, by detecting the position of the openings of the blind holes 68 or the position of a positioning marking provided on the inner or outer surface of the blank 50. This detection may be made by using a suitable device such as a CCD camera.

The positioning marking may be a protrusion or a recess formed on the blank 50. In this case, the marking can be formed during injection molding of the blank 50. If the protrusion is formed on the inner surface of the blank 50 in which the blind holes 68 are formed, the protrusion should be located at a position outside the area at which the nozzle plate 61 is bonded to the ink-chamber member 26, or alternatively the ink-chamber member 26 should have a recess which accommodates the positioning protrusion on the nozzle plate. The positioning marking may be a surface area on the blank 50, which has a color or optical characteristic (e.g., reflectance) different from that of the surface area which surrounds the marking area. The marking area may be replaced by a film-like marking such as a suitably colored film.

In the present embodiment wherein the cross sectional area of the laser beam 92 is smaller than the area of the bottom surface of the blind hole 68 so that only a central portion of the bottom wall 66 is removed, the inclined surface of the blind hole 68 may be partially exposed to the laser beam 92 if the axis of the laser beam 92 is excessively offset from or misaligned with respect to the center of the blind hole 68. In this event, the area of the bottom wall 66 that is irradiated by the laser beam 92 is reduced, whereby the cross sectional area of the orifice portion 62 formed is smaller than the nominal value (equal to the cross sectional area of the laser beam 92), and also the formed orifice portion 62 has a cross sectional shape different from the nominal shape. If the nominal cross sectional shape of the orifice portion 62 is circular, the formed orifice portion 62 formed has an asymmetric cross sectional shape. This causes the ink droplet to have a size smaller than the nominal size, and leads to instability of the ink jetting direction.

Therefore, the bottom wall 66 should be irradiated by the entire cross sectional area of the laser beam 92. However, it is impossible to zero the amount of misalignment of the axis of the laser beam 92 with respect to the center of the bottom wall 66. In this respect, it is desirable that the cross sectional size of the laser beam 92 be smaller than the size of the bottom wall 68 by an amount equal to an expected maximum amount of misalignment between the laser beam 92 and the bottom wall 68.

Where the cross sectional area of the laser beam 92 is smaller than the area of the bottom wall 68, a shoulder surface is left at the boundary between the tapered portion 63 and the orifice portion 62 of the ink-jet hole 64. Since this shoulder surface faces the ink chamber 12, air bubbles are unlikely to stay in the ink chamber 12, for the reason explained below by reference to FIG. 7. If the shoulder surface has a considerably large area, however, the tapered portion 63 cannot function as a part of the ink-jet hole 64, and the air bubbles tend to be easily introduced into the ink chamber 12, as in the case where the ink-jet holes are formed through a sheet-like nozzle plate as disclosed in JP-A-61-32761.

It is accordingly desirable that the maximum dimension of the shoulder surface created at the boundary of the tapered and orifice portions 63, 62 be smaller than 20 μm, preferably smaller than 15 μm. These upper limit values of the maximum dimension of the shoulder surface are determined in view of a fact that air bubbles of about 30–40 μm diameter remaining in the ink chamber 12 adversely influence the ink jetting performance of the ink jet head.

The first embodiment in which the laser beam 91 is used as shown in FIG. 5(*a*) may be modified so that the cross sectional area of the laser beam 91 covers a plurality of blind holes 68 but does not cover all of the blind holes 68. In this case, the blind holes 68 are grouped into two or more groups, and the bottom walls 66 of the blind holes 68 of each group are concurrently irradiated with the laser beam 91. Each time the bottom walls 66 of one group of blind holes 68 have been removed by the laser beam 91, the laser beam 91 is moved relative to the blank 50 to irradiate the bottom walls 66 of the next group of blind holes 68. Thus, the irradiation of the blank 50 with the laser beam 91 is repeated two or more times until all the ink-jet holes 64 are formed.

The embodiment of FIG. 6(*a*) using the local laser beams 92 may be similarly modified. That is, the number of the laser beams 92 is smaller than the number of the blind holes 68, and the laser beams 92 are moved relative to the blank 50 after each group of bottom walls 66 is irradiated with the laser beams 92.

In the embodiments of FIGS. 5(*a*) and 6(*a*) and the modified embodiments indicated above, the burr left on the blank 50 may be removed by exposure to the laser beam 91 or 92.

Further, the cross sectional area of the laser beam 91 may be selected so as to cover the bottom wall 66 of only one blind hole 68, or the mask used in the embodiment of FIG. 6(*a*) may be modified to emit only one laser beam 92. In this case, the bottom walls 66 of all the blind holes 68 are irradiated one after another, with the position of the laser beam 91, 92 changed relative to the blank 50.

In the above case, the burr left on the inner surface of the blank 50 may be removed by focusing the laser beam 91, 92 on the inner surface of the blank and moving the laser beam along the burr (formed along the interface of the two cores 110, 111), before or after the orifice portions 62 are formed. This laser-beam irradiation of the blank 50 is repeated until the burr is completely removed.

Figure 7:
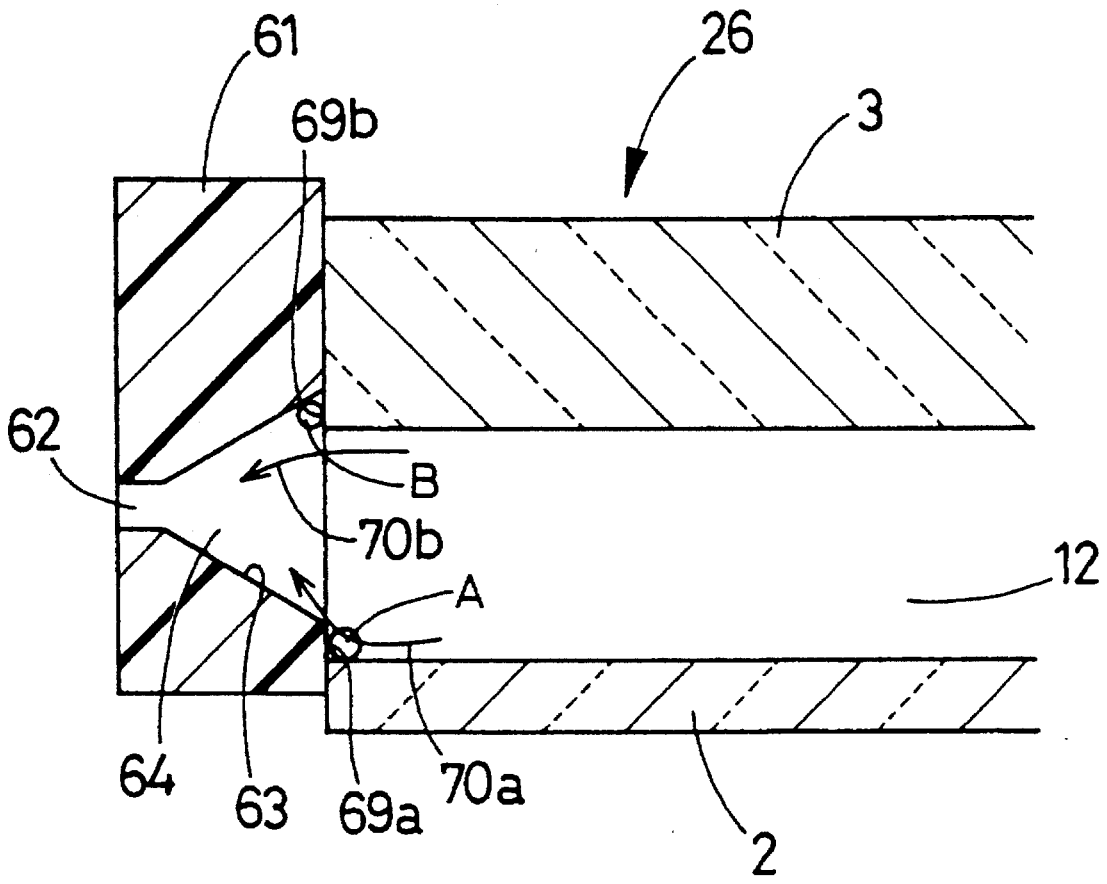
FIG. 7 is a cross sectional view illustrating misalignment of the nozzle plate relative to an ink-chamber member of the ink jet head, which misalignment adversely affects jetting of an ink from an ink-jet hole formed through the nozzle plate.

The nozzle plate 61 thus prepared is bonded to the front end face of the ink-chamber member 26 by a suitable bonding agent such as an epoxy resin, whereby the ink jet head 1 is produced. Where the height dimension of the ink chamber 12 at its ink outlet end is equal to that of the ink-jet hole 64 at its ink inlet end, shoulder surfaces are created at the interface between the ink-chamber member 26 and the nozzle plate 61, if the nozzle plate 61 is misaligned with respect to the ink-chamber member 26 during the bonding process, in the direction indicated by arrow Y in FIG. 1, for example, as illustrated in FIG. 7. These shoulder surfaces, which are indicated at 69*a* and 69*b* in FIG. 7, are likely to hold air bubbles once introduced into the ink-jet holes 64 and ink chambers 12. Where air bubbles A are present adjacent to the shoulder surface 69*a* facing the ink chamber 12, the bubbles A are relatively easily discharged out of the ink-jet hole 64, due to a flow of the ink indicated by arrow 70*a*. Where air bubbles B are present adjacent to the shoulder surface 89*b* facing the ink-jet hole 64, however, the bubbles B are less likely to be discharged due to an ink flow indicated by arrow 70*b*.

The air bubbles remaining in the ink chamber 12 undergo repeated alternate contraction and expansion in response to alternate decrease and increase of the volume of the ink chamber 12 during operation of the ink jet head 1. thus, the air bubbles prevent normal jetting of the ink from the ink-jet holes 64.

To avoid the above drawback, it is necessary to draw a certain amount of the ink out of the ink-jet holes 64 for causing a flow of the ink through the ink chambers 12 and ink-jet holes 64, to thereby discharge the air bubbles together with a stream of the ink. This operation is not effective to remove the air bubbles B present near the shoulder surface 69*b* facing the ink-jet hole 64. Rather, the operation to remove the air bubbles may even cause a vortex downstream of the shoulder surface 69*b*, which vortex acts to hold the air bubbles remaining adjacent to the shoulder surface 69*b*.

Conventionally, the ink jet head 1 is rejected as an unacceptable product if the amount of misalignment of the ink-jet holes 64 and the ink chambers 12 exceeds a certain upper limit. Thus, the misalignment of the nozzle plate 61 and the ink-chamber member 26 lowers the yield ratio or acceptance ratio of the ink jet head 1.

While FIG. 7 shows the ink jet head wherein the height dimension of the ink chamber 12 at its ink outlet end is almost equal to that of the ink inlet opening of the tapered portion 63 of the ink-jet hole 64, the dimensions (85 μm×485 μm) of the ink outlet end of the ink chamber 12 are made considerably larger than those (60 μm×400 μm) of the ink outlet end of the ink-jet hole 64, in the embodiments described above. According to this arrangement, all the shoulder surfaces face the ink chamber 12 unless the amount of misalignment of the nozzle plate 61 relative to the ink-chamber member 26 is considerably large. In other words, a shoulder surface facing the ink-jet hole 64 is formed only where the amount of misalignment does not fall within a relatively wide range of tolerance.

However, the width dimension of the ink outlet open end of the ink chamber 12 is larger than that of the ink inlet open end of the ink-jet hole 64 (tapered portion 63), by only 25 μm, in the direction indicated by arrow X in FIG. 1. Therefore, a shoulder surface facing the ink-jet hole 64 is created at the interface between the nozzle plate 61 and the ink-chamber member 26, if the amount of misalignment between these members 61, 26 in the above-indicated direction X exceeds ±12.5 μm. To avoid this intolerable amount of misalignment of the nozzle plate 61 with respect to the ink-chamber member 26, the relative position of these members 61, 26 in the above-identified width direction X is detected by a CCD camera and adjusted by a robot on the basis of an output of the CCD camera so that the amount of misalignment of the members 61, 26 falls within a tolerable range, before or while the nozzle plate 61 is bonded to the ink-chamber member 26.

On the other hand, the height dimension of the ink outlet open end of the ink chamber 12 is larger than that of the ink inlet open end of the ink-jet hole 64 (tapered portion 63), by as large as 85 μm, in the direction indicated by arrow Y in FIG. 1. Therefore, a shoulder surface facing the ink-jet hole 64 is not created at the interface between the nozzle plate 61 and the ink-chamber member 26, unless the amount of misalignment between these members 61, 26 in the above-indicated direction Y exceeds αν ξρρεθ ωιμιτ οπ πσ ωαθλε ασ ±42.5 μm. Accordingly, the pair of positioning extensions 67 described above is used for positioning the nozzle plate 61 relative to the ink-chamber member 26 in the above-indicated height direction Y. To this end, a distance between the inner surfaces of the two positioning extensions 67 is determined to be almost equal to but slightly larger than the total thickness of the piezoelectric ceramic plate 2 and the two cover plates 3 of the ink-chamber member 26, so that the nozzle plate 61 may be accurately aligned with the piezoelectric ceramic plate 2 by simply positioning the front end portion of the ink-chamber member 26 between the two positioning extensions 67 of the nozzle plate 61. The total thickness of the three plates 2, 3 is slightly smaller than the thickness of the ink-chamber member 26 which consists of the center ceramic plate 2 and the two cover plates 3 bonded to the opposite surfaces of the plate 2.

Figure 10:
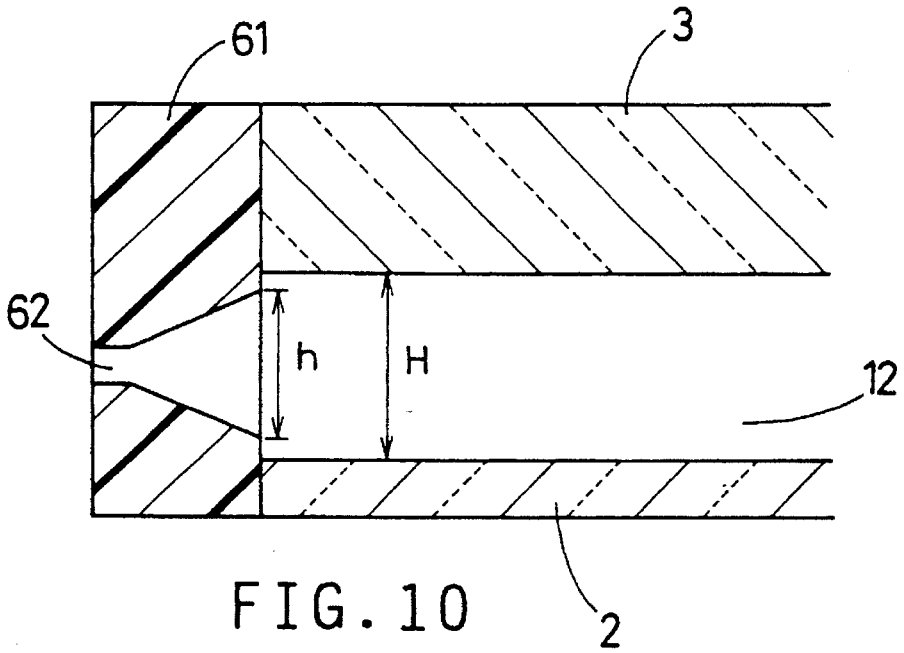
FIG. 10 is a cross sectional view indicating the size difference H–h of the ink-jet hole and the ink chamber.

To avoid a shoulder surface facing the ink-jet hole 64, it is desirable to increase a difference (e.g., height difference H–h as indicated in FIG. 10) between the sizes of the ink outlet open end of the ink chamber 12 and the ink inlet open end of the ink-jet hole 64. On the other hand, an increase in the size difference indicated above results in a decrease in the taper angle of the tapered portion 63 of the ink-jet hole 64, and a decrease in the cross sectional area of the tapered portion 63 at its ink inlet open end, whereby air is more likely to be introduced into the ink chamber 12. Further, the increase in the size difference results in an increase in the area of the shoulder surface facing the ink chamber 12, which disturbs a flow of the ink from the ink chamber 12 into the ink-jet hole 64. In this respect, too, the size difference is desirably small.

An optimum amount of the size difference of the tapered portion 63 and the ink chamber 12 is determined depending upon a desired tolerance of misalignment of the nozzle plate 61 and the piezoelectric ceramic plate 2 when the nozzle plate 61 is bonded to the ink-chamber member 26. In this respect, the actual amount of misalignment of the nozzle plate 61 relative to the ceramic plate 2 was measured on test specimens of the ink jet head, which were manufactured by bonding the nozzle plate 61 to the ink-chamber member 26 while the relative position of these two members 61, 26 was detected and adjusted by using a CCD camera so as to align the nozzle plate 61 with respect to the ceramic plate 2, in the width and height directions X and Y (FIG. 1).

The measurement was conducted on 70 ink jet head specimens wherein the width and height dimensions of the ink inlet open end of the ink-jet holes 64 of the nozzle plate 71 are 85 μm and 485 μm, respectively, while the width and height dimensions of the ink outlet open end of the ink chambers 12 are also 85 μm and 485 μm, respectively.

Figure 8:
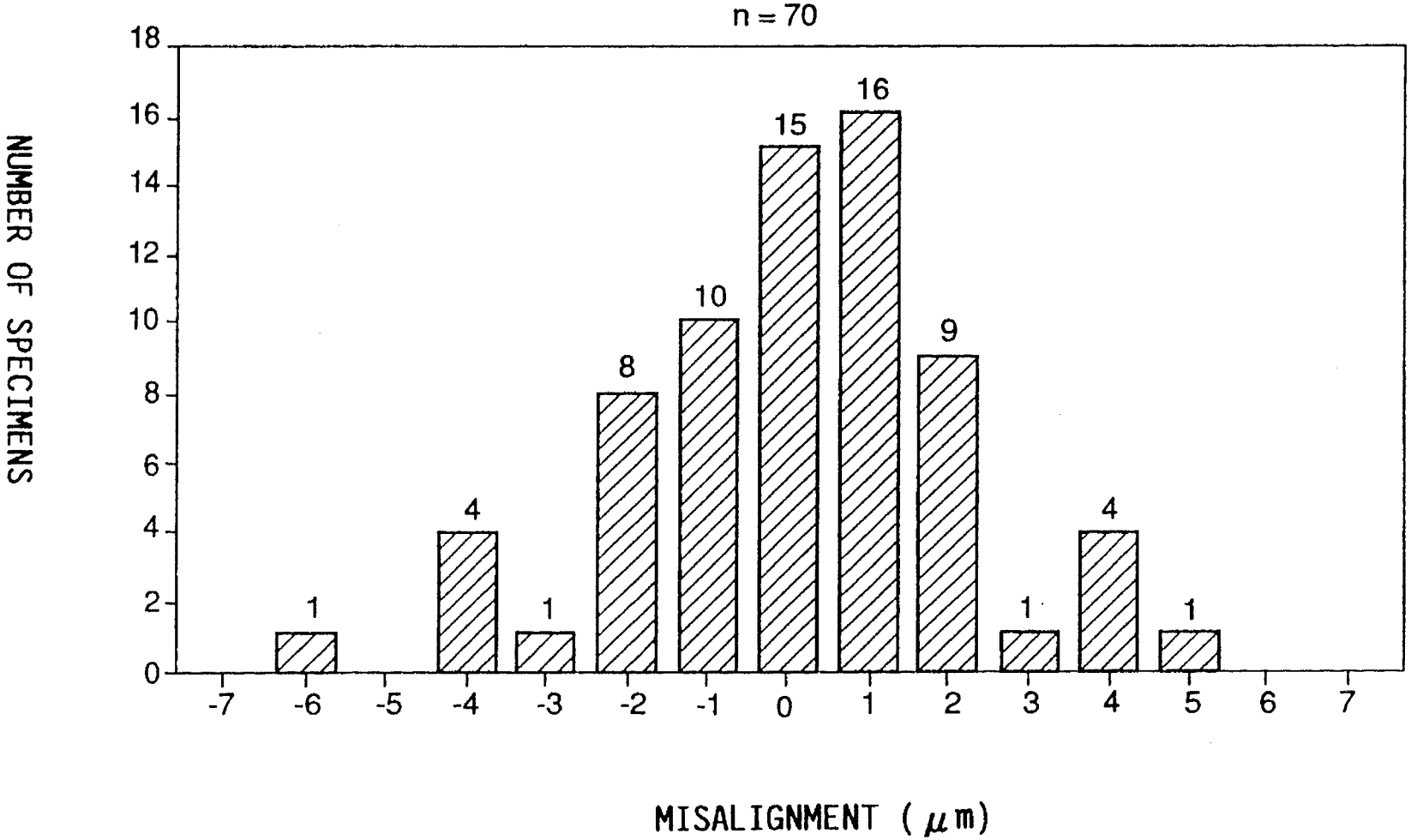
FIG. 8 is a graph indicating a distribution of misalignment values of the nozzle plate with respect to the ink-chamber member, as obtained by experiments on test specimens.

Each of the ink jet head specimens was placed on an X-Y table having scales along the X and Y axes, and the amounts of misalignment of the nozzle plate 61 and the ceramic plate 2 in the width and height directions X and Y of the ink outlet and inlet open ends of the ink chamber 12 and ink-jet hole 64 were measured by an optical microscope. The large one of the misalignment amounts in the width or height direction was taken as the misalignment amount of each specimen. The graph of FIG. 8 shows a distribution of the misalignment amounts obtained by the test, irrespective of the direction of the misalignment, that is, either the width direction or the height direction. The plus and minus signs of the misalignment value (μm) correspond to the rightward and leftward misalignment in the width direction, respectively, and the upward and downward misalignment in the height direction, respectively.

It will be understood from the graph of FIG. 8 that the amounts of misalignment of the nozzle plate 61 with respect to the piezoelectric ceramic plate 2 are held within a range of ±6 μm for all of the 70 specimens. In other words, shoulder surfaces facing the ink-jet hole 64 would not be created at the interface of the nozzle plate 61 and the ink-chamber member 26 due to their misalignment, if the width and height dimensions of the ink outlet open end of each ink chamber 12 are larger than those of the ink inlet open end of the ink-jet hole 64, by at least 12 μm. Thus, the yield percent or acceptance percent of the products acceptable as the ink jet head which meets the misalignment tolerance is 100% if the size difference is at least 12 μm.

Figure 9:
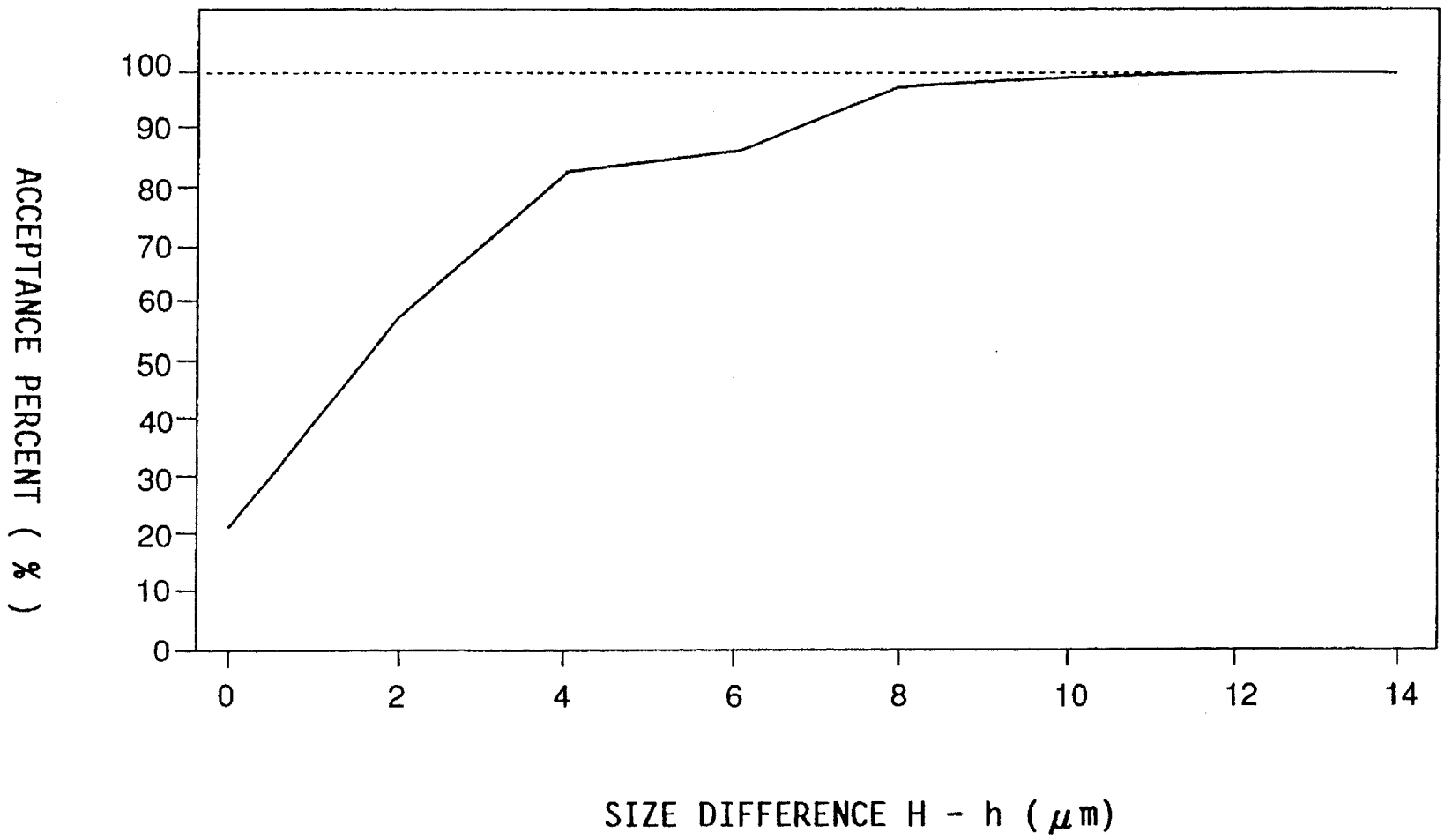
FIG. 9 is a graph indicating a relationship between the yield ratio of the ink jet head and a size difference of the ink-jet hole and the ink chamber as measured at the connection of the nozzle plate and ink-chamber member.

The graph of FIG. 9 shows a relationship between the acceptance percent (%) of the ink jet head and the size difference (e.g., height difference H–h), which is obtained from the distribution data of FIG. 8.

It will be understood from the graph of FIG. 9 that the size difference should be at least 4 μm if it is desired to manufacture the ink jet head with a yield or acceptance percent of 80% or higher. Similarly, the size difference should be at least 8 μm and 12 μm if the desired yield percent is at least 90% and 100%, respectively.

To confirm the above assumption, an ink jetting test was conducted on test specimens in which the width and height dimensions of the ink outlet open end of the ink chambers 12 are 85 μm and 485 μm, respectively, while the width and height dimensions of the ink inlet open end of the ink-jet holes 64 are 70 μm and 470 μm, respectively. That is, the dimensional differences in the width and height directions are both 15 μm. The height difference is equal to (H–h) as indicated as FIG. 10. Each specimen ink jet head was manufactured by bonding the nozzle plate 1 to the ink-chamber member 26 while these members 61, 26 were positioned for alignment by using a CCD camera as described above. The specimen heads were operated to check to see if the heads exhibited satisfactory ink jetting characteristics or not. The test showed that 98% of the specimens were acceptable. It appears that factors other than the size difference prevented the 100% acceptance of the specimens.

A similar test was conducted on comparative specimens wherein the size difference (H–h) is 2 μm. The test showed 56% acceptance of the specimens in term of the ink jetting characteristics. Thus, the tests confirmed a significant influence of the size difference on the yield ratio or acceptance percent of the ink jet head.

In the above tests, the nozzle plate 61 and the ink-chamber member 26 were aligned with each other with high accuracy using the CCD camera, so that the amounts of misalignment of all the specimens were held within the range of ±6 μm. In this condition, the required size difference is at least 4 μm, at least 8 μm and at least 12 μm to assure the minimum acceptance percent of 80%, 90% and 100%, as described above. If the alignment accuracy of the nozzle plate 61 and the ink-chamber member 26 by using the CCD camera is lower than that in the above-indicated tests, the required size difference values should be increased accordingly. In any case, the optimum range of the size difference value can be determined depending upon the actual alignment accuracy, and the desired tolerance of the misalignment, namely, the desired yield ratio or acceptance ratio of the ink jet head.

Figure 11:
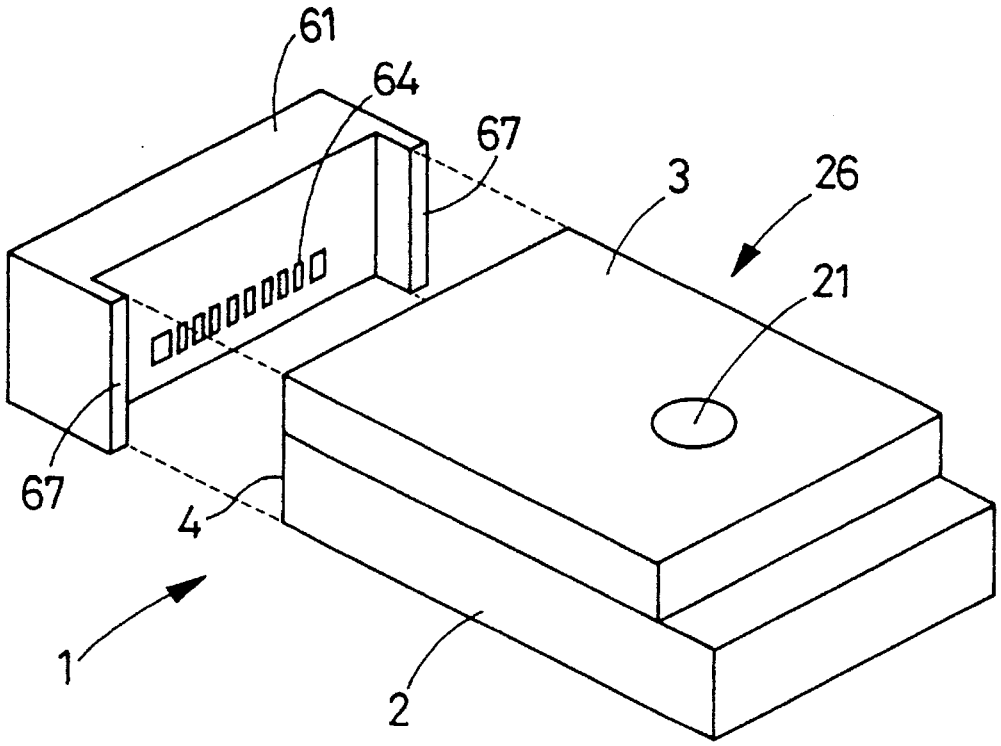
FIG. 11 is a perspective view illustrating an ink jet head manufactured by a method according to a third embodiment of the invention.
Figure 12:
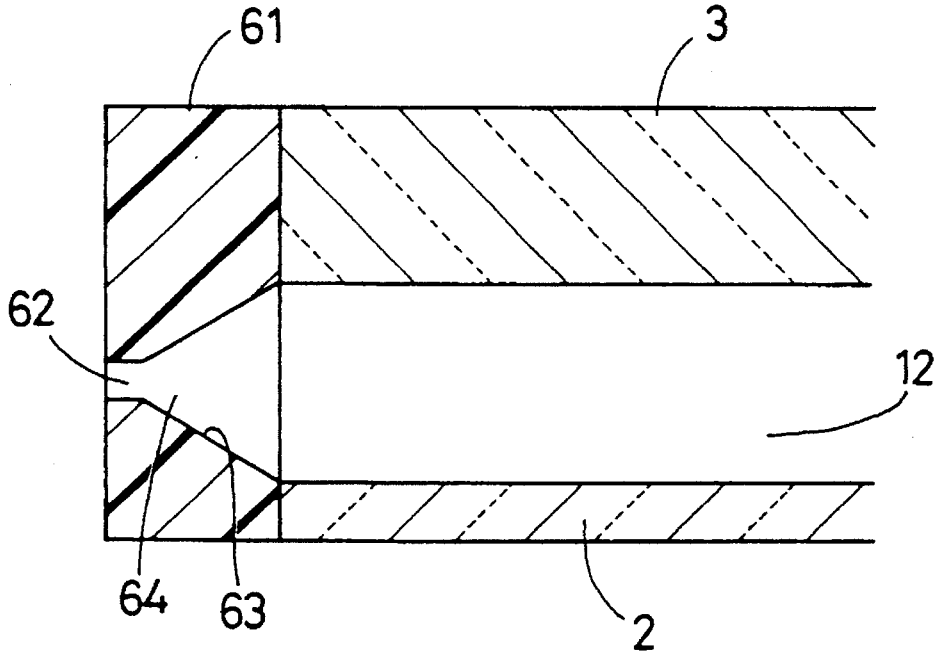
FIG. 12 is a cross sectional view showing a front end portion of the ink jet head of FIG. 11.

Referring next to FIGS. 11 and 12, there will be described the ink jet head 1 manufactured according to a further embodiment of the present invention.

This ink jet head 1 also includes the ink-chamber member 26, but the piezoelectric ceramic plate 2 of the ink-chamber member 26 has only one array of parallel grooves 8 which are closed by the single ceramic cover plate 3 bonded by an epoxy resin adhesive to the plate 2, whereby a single array of ink chambers 12 is formed within the ink-chamber member 26.

The nozzle plate 61 is bonded to the front end face of the ink-chamber member 26 by an epoxy resin adhesive, to form the ink jet head 1. The nozzle plate 61 has a single row of ink-jet holes 64 communicating with the ink chambers 12, and a pair of positioning extensions 67 for positioning the nozzle plate 61 relative to the ink-chamber member 26 in the direction of the row of the ink-jet holes 64.

Each ink-jet hole 64 of the nozzle plate 61 consists of the tapered portion 63 and the orifice portion 62, as in the preceding embodiments.

The nozzle plate 61 is prepared from the blank 50 formed by injection molding of a resin material, polyphenylene sulfide. The blank 50 has a row of blind holes corresponding to the tapered portions 63, and is subjected to an operation to form the orifice holes or portions 62 by excimer laser, in substantially the same manner as described above.

In the present ink jet head 1, too, each each ink-jet hole 64 formed through the nozzle plate 61 has a sufficiently large volume, and no burr is left near the orifice portion 62 of the ink-jet hole 64.

Figure 19:
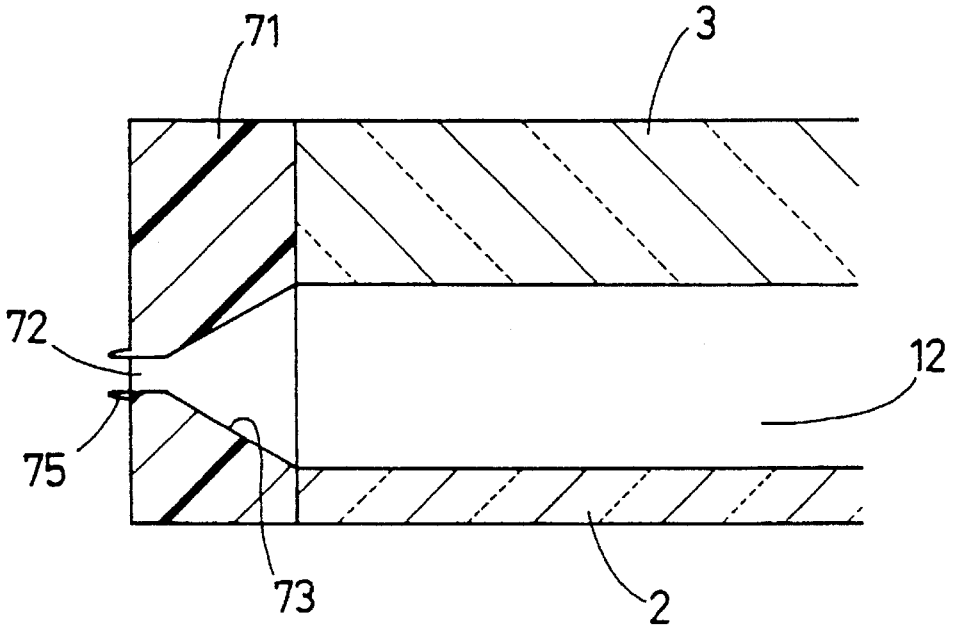
FIG. 19 PRIOR ART
FIG. 19 is a cross sectional view depicting a burr left around the edge of the ink outlet end of the ink-jet hole of a known ink jet head whose nozzle plate is formed by an injection mold shown in FIGS. 20(*a*) and 20(*b*)
Figure 20A:
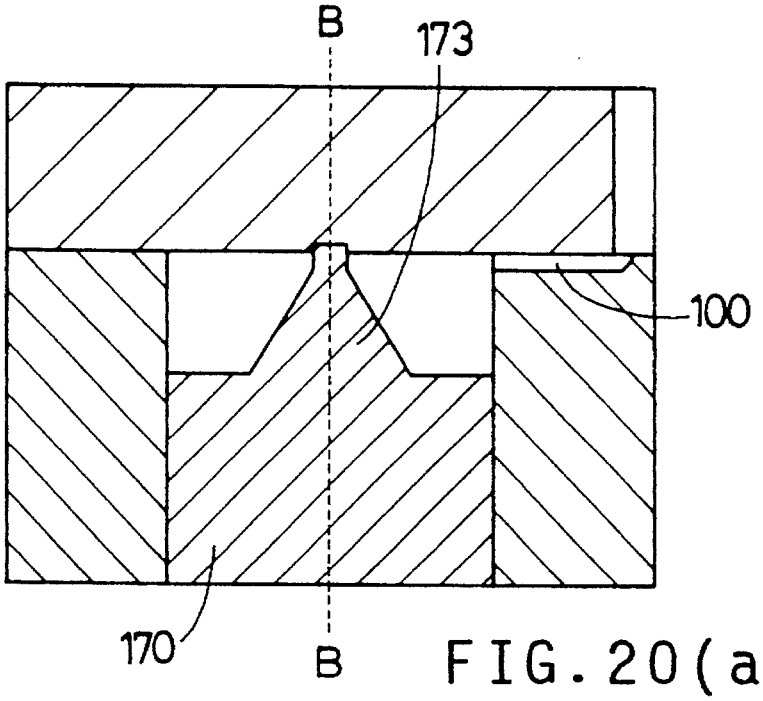
FIG. 20(a) PRIOR ART
FIGS. 20(*a*) and 20(*b*) are cross sectional views showing the injection mold for forming the nozzle plate of the ink jet head of FIG. 19.
Figure 20B:
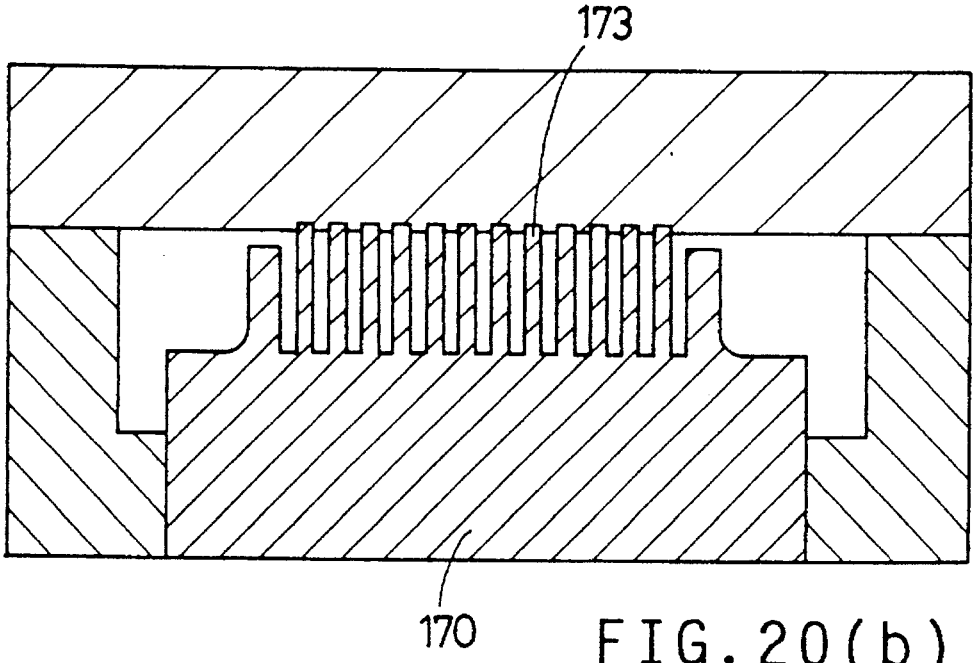
FIG. 20(b) PRIOR ART
Figure 21:
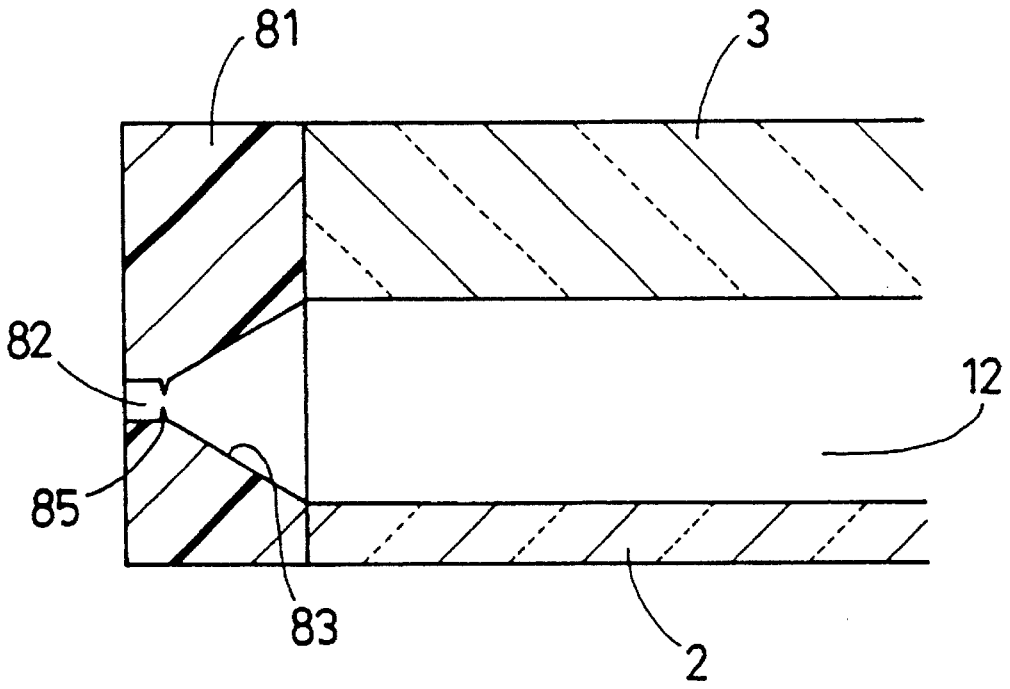
FIG. 21 PRIOR ART
FIG. 21 is a cross sectional view depicting a burr left at the connection of an orifice portion and a tapered portion of the ink-jet hole of a known ink jet head whose nozzle plate is formed by an injection mold shown in FIGS. 22(*a*) and 22(*b*)
Figure 22A:
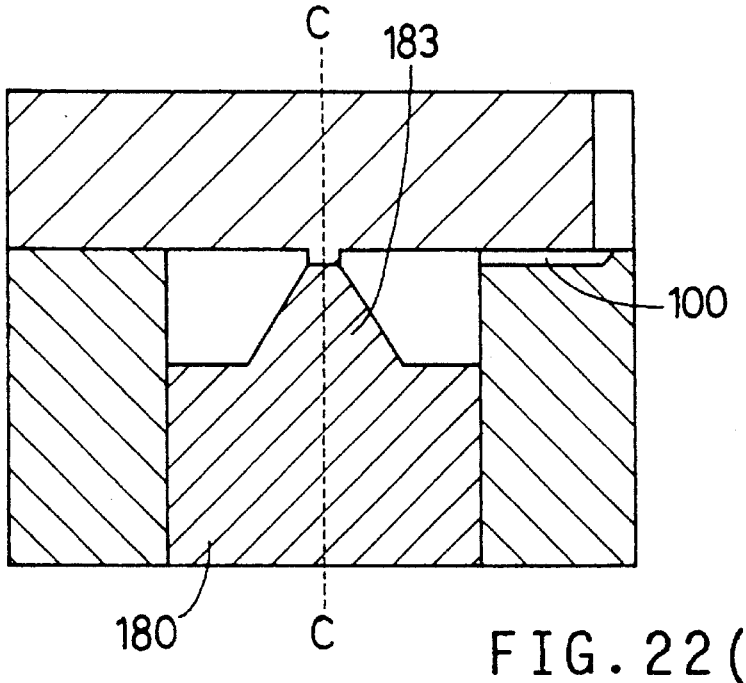
FIG. 22(a) PRIOR ART
FIGS. 22(*a*) and 22(*b*) are cross sectional view showing the injection mold for forming the nozzle plate of the ink jet head of FIG. 21.
Figure 22B:
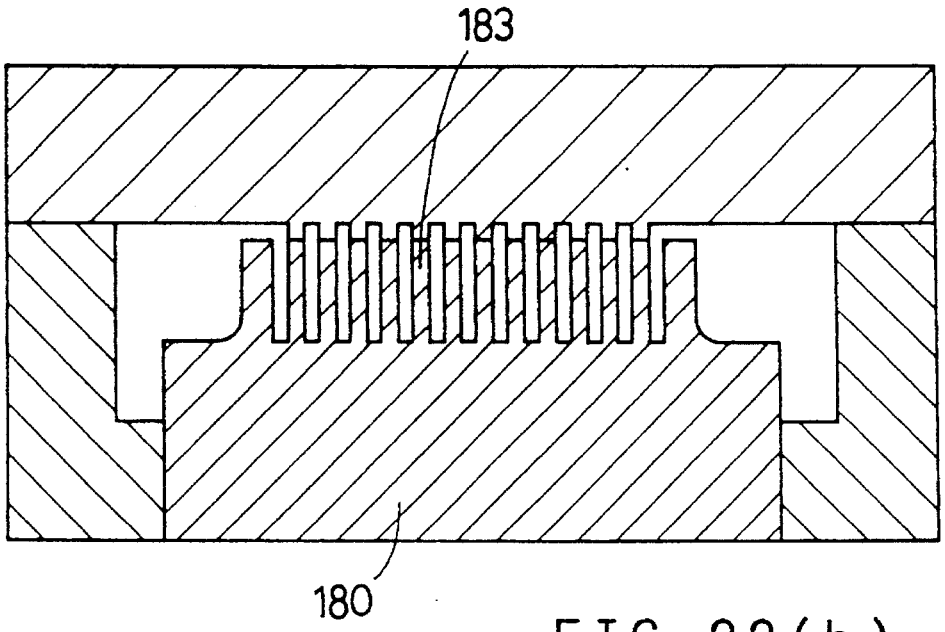
FIG. 22(b) PRIOR ART

For comparison of the present method with the conventional method, an ink jetting test was conducted on the ink jet head 1 of FIG. 12 manufactured according to the present invention and the ink jet heads of FIGS. 19 and 21 whose nozzle plates 71, 81 were prepared by the conventional method as described above. The test showed deviation of the ink jetting direction from the nominal path and instability of the ink jetting performance on the ink jet heads of FIGS. 19 and 21, due to the burr 75, 85. To the contrary, the ink jet head of FIG. 12 according to the present invention exhibited improved ink jetting characteristics without deviation of the ink jetting path, and excellent better quality of images printed, in the absence of the burr 75, 85.

A test was conducted also on the ink jet head using the film-like nozzle plate 31 which has the ink-jet holes 32 formed by excimer laser. The test showed frequent entry of air into the ink chamber 12 due to a considerably small volume of the ink-jet hole 32, and poor ink jetting characteristics of the head. On the other hand, the ink jet head of FIG. 12 using the nozzle plate 61 did not suffer from air entry into the air chamber 12, and exhibited excellent ink jetting performance.

While it is desirable to reduce the length of the orifice portion 62 to reduce the reduced required voltage for the ink jetting, a decrease in the length of the orifice portion 62 means a decrease in the thickness of the nozzle plate 64, which leads to an increased flow resistance of the material when the nozzle plate (blank 50) is injection-molded. In the light of these two factors, the length of the orifice portion 62 is desirably within a range of 30–200 μm.

While the nozzle plate 61 in the embodiment of FIG. 11 has the two positioning extensions 67 at the right and left ends as shown in FIG. 11 to position the nozzle plate 61 in the direction parallel to the direction of the row of the ink-jet holes 64, the nozzle plate 61 may be provided with a pair of positioning extensions at the upper and lower ends to position the nozzle plate in the direction perpendicular to the direction of the row of the ink-jet holes 64.

Figure 13:
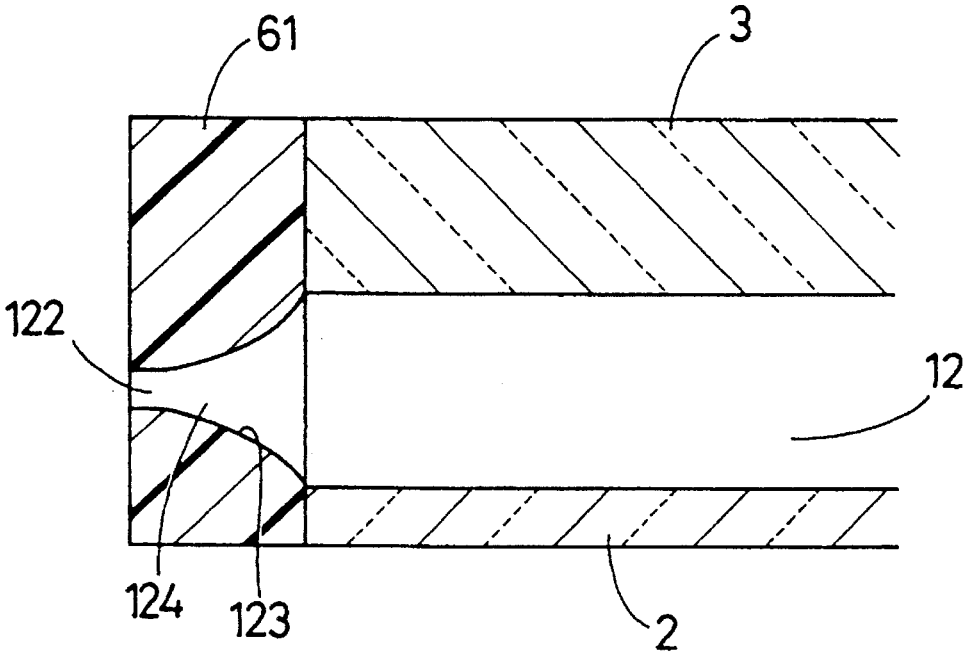
FIG. 13 is a cross sectional view of an ink jet head manufactured by a method according to a fourth embodiment of the invention.

Referring to FIG. 13, there is shown an ink jet head manufactured by a method according to a still further embodiment of this invention. The present ink jet head is characterized by the shape of an ink-jet hole 124 formed through the nozzle plate 61. The ink-jet hole 124 consists of an orifice portion 122, and a varying-area portion in the form of a trumpet-shaped portion 123 which corresponds to the tapered portion 63 in the preceding embodiments.

In the preceding embodiments, the tapered portion 63 is formed by the tapered projection 103 formed on the core 110 (111) of the injection mold, which projection 103 has a trapezoid shape in cross section, with its width decreasing linearly in the direction from the bottom toward the top. In the present embodiment, however, each projection formed on the core 110 for forming the trumpet-shaped portion 123 has a trumpet shape so that the rate of decrease in the cross sectional area of the projection in the above-indicated direction decreases in the same direction. Accordingly, the trumpet-shaped portion 123 of the ink-jet hole 124 has a height dimension which decreases in the direction from its ink inlet open end toward the ink outlet end such that the rate of decrease of the height dimension decreases in the same direction.

The trumpet-shaped portion 123 as the varying-area portion of the ink-jet hole 64 permits more smooth flows of the ink than the tapered portion 63. While it is difficult to form the ink-jet hole 124 by exposure to an excimer laser beam while the blank and the laser beam are moved relative to each other as in the prior art disclosed in EP-A-0309146, the ink-jet hole 124 can be comparatively easily formed according to the present invention, by forming the trumpet-shaped portion 123 by injection molding and forming the orifice portion 122 by laser-cutting as described above with respect to the orifice portion 62.

Although the nozzle plate 61 is formed of polyphenylene sulfide in the illustrated embodiments, it may be formed of other resin materials such as liquid crystal polymer, polyacetal, polyphenyl sulfone, polyphthal amido, polyphenylene oxide, polysulfone, polyether imide, polyether sulfone and polycarbonate.

The nozzle plate 61 may be formed by injection molding of a powdered ceramic or metal. For example, a ceramic or metal powder and a binder such as a resin material are mixed and kneaded, and a mixture obtained is shaped by injection molding. The shaped body is subjected to a heat-treatment process to remove the binder (resin). The heat-treated body is then sintered in a sintering furnace. Since the sintered boy is reduced in size due to shrinkage during sintering, the size of the shaped body obtained by injection molding should be larger than the desired final size by the amount of the shrinkage during sintering. Generally, the injection molding technique is not suitable for the manufacture of a nozzle plate of an ink jet head having a high density of ink-jet holes, because the high-density ink-jet holes cause a relatively high resistance of flow of the material in the injection mold. However, the use of a ceramic or metal powder makes it possible to manufacture such nozzle plate by injection molding. The sintered ceramic or metal body is subjected to an operation to form the orifice portions 72 by excimer laser, for producing the nozzle plate 61. The ceramic or metal material may be selected from among alumina, zirconia, silicon nitride, silicon carbide and stainless steel.

While the present invention has been described above in its presently preferred embodiments, it is to be understood that the present invention is not limited to the details of the illustrated embodiments, but may be otherwise embodied without departing from the spirit and scope of the invention defined in the appended claims.

In the embodiments of FIGS. 12 and 13, the ink outlet opening of the ink chambers 12 and the ink inlet opening of the ink-jet holes 64, 124 have the same size, the size of the former can be made larger than that of the latter, as in the embodiment of FIG. 10, to improve the yield ratio of the ink jet head.

In the illustrated embodiments, the ink-jet hole 64, 124 has the varying-area portion in the form of the tapered portion 63 or trumpet-shaped portion 123. However, the varying-area portion may be suitably designed with their dimensions and taper angle or height decrease rate being determined so as to prevent entry of air into the ink chamber 12.

Although the height of the varying-area portion decreases in the direction from the ink inlet open end toward the ink outlet end of the ink-jet hole, the width dimension rather than or as well as the height dimension may decrease. While the orifice portion and the varying-area portion have a square or rectangular cross sectional shape in the illustrated embodiments, the cross sectional shape is limited to the square or rectangle, but may be a circular, elliptical or other shape. The projection 103 may be modified such that the cross sectional shape in a plane parallel to the end face of the core 110 (111) on which the projection 103 is formed is rectangular at the lower portion of the projection 103, and circular at the upper portion, so that the blind hole 68 formed by the projection 103 has a circular cross sectional shape at its small end adjacent to the orifice portion. Such modified projection 103 having a circular upper end portion may be formed by first forming the projection 103 by a mechanical cutting process in the manner described above, and then rounding the corner portions by laser cutting such that the degree of rounding of the corner portions increases in the direction from the bottom toward the top of the projection.

The nozzle plate 61 may have three or more rows of ink-jet holes 64, 124.

Although an adhesive or bonding agent is used to bond the nozzle plate 61 to the ink-chamber member 26 in the illustrated embodiments, other means may be used to secure the nozzle plate to the ink-chamber member. For instance, one of the nozzle plate and the ink-chamber member is provided with a recess or opening in which the other member is mechanically press-fitted or shrink-fitted due to a temperature difference. Of course, the nozzle plate 61 is fixed to the ink-chamber member 26 by suitable fastening means such as screws.

While the excimer laser is used to form the orifice portion 62, 122 in the illustrated embodiments, other types of laser may be used. For instance, YAG laser may be used together with a quarter wavelength plate.

The method of manufacturing the ink jet head according to the present invention, particularly, method of preparing the nozzle plate and bonding it to the ink-chamber member is equally applicable to various types of ink jet head such as the one using piezoelectric actuator units, and so-called "bubble-jet type".

What is claimed is:

1. A method of manufacturing an ink jet head including an ink-chamber member having a plurality of ink chambers to be filled with an ink, and a nozzle plate which is secured to a front end face of said ink-chamber member and which has a plurality of ink-jet holes communicating with said plurality of ink chambers, respectively, said method comprising the steps of:

forming by injection molding a blank for said nozzle plate, said blank having a plurality of blind holes formed in one of opposite surfaces thereof which corresponds to a surface of said nozzle plate at which said nozzle plate is secured to said front end face of said ink-chamber member, said blank having bottom walls each defining a bottom of said blind holes, respectively, each of said blind holes having a varying-area portion whose cross sectional area decreases in a direction from said one of opposite surfaces toward said bottom;

laser-cutting said blank, with at least one laser beam, to remove at least a portion of each of said bottom walls and thereby form a plurality of orifice holes which cooperate with said blind holes to form said ink-jet holes, whereby said nozzle plate is prepared; and securing said blank to said front end face of said ink-chamber member before said blank is laser-cut, or securing said nozzle plate to said front end face of said ink-chamber member after said nozzle plate is prepared by laser-cutting said blank.

2. A method according to claim 1, wherein said step of forming by injection molding a blank comprises forming said blind holes such that a size of said each blind hole at an open end thereof is smaller than a size of a corresponding ink chamber at an end thereof at which said ink chamber communicates with a corresponding ink-jet hole.

3. A method according to claim 2, wherein said step of forming by injection molding a blank comprises determining a difference between said size of said each blind hole and said size of the corresponding ink chamber, depending upon a desired tolerance of misalignment of said nozzle plate and said ink-chamber member when said nozzle plate is secured to said ink-chamber member.

4. A method according to claim 3, wherein said difference is at least 4 μm.

5. A method according to claim 4, wherein said difference is at least 8 μm.

6. A method according to claim 5, wherein said difference is at least 12 μm.

7. A method according to claim 1, wherein said step of laser-cutting said blank comprises irradiating said bottom walls of said blank with a laser beam such that said laser beam is incident upon said bottom of said each blind hole through an open end of said each said blind holes.

8. A method according to claim 1, wherein said step of laser-cutting said blank comprises removing said bottom walls of said blank by excimer laser.

9. A method according to claim 1, wherein said step of laser-cutting said blank comprises simultaneously irradiating at least a plurality of said bottom walls with a single laser beam having a cross sectional area which covers an area of said blank in which said plurality of said bottom walls are located.

10. A method according to claim 1, wherein said step of forming by injection molding a blank comprises forming a plurality of rows of said blind holes each having said varying-area portion.

11. A method according to claim 10, wherein said step of forming a plurality of rows of said blind holes comprises using a mold which includes a plurality of cores corresponding to said plurality of rows of said blind holes, respectively, each of said cores having a row of projections for forming the corresponding row of said blind holes.

12. A method according to claim 11, wherein said plurality of cores have respective ribs which cooperate to form a recess in said one of opposite surfaces of said blank when said blank is injection-molded with said cores butted together so as to form an end surface from which said projections and said ribs extend.

13. A method according to claim 11, wherein said step of forming a plurality of rows of said blind holes comprises butting together said plurality of cores such that said cores cooperate to form an end surface from which said projections extend and which forms said one of opposite surfaces of said blank, said step of laser-cutting said blank further comprising a step of irradiating a portion of said one of opposite surfaces of said blank which portion corresponds to an interface of said plurality of cores, with a laser beam, to remove a burr produced at said varying-area portion of said one of opposite surfaces of the blank.

14. A method according to claim 1, wherein said step of laser-cutting said blank comprises irradiating said bottom walls of said blank with a laser beam such that said laser beam is incident upon said bottom of said each blind hole through an open end of said each blind hole, and wherein said laser beam has a cross sectional area larger than that of said bottom of said each blind hole.

15. A method according to claim 1, wherein said step of laser-cutting said blank comprises irradiating said bottom walls of said blank with a laser beam which has a cross sectional area smaller than that of said bottom of each blind hole.

16. A method according to claim 1, wherein said varying-area portion of said each blind hole has a constant width dimension and a height dimension which decreases in said direction from said one of opposite surfaces toward said bottom.

17. A method according to claim 1, wherein said bottom walls defining the bottoms of the blind holes have a thickness of 30–200 μm.

18. A method according to claim 1, wherein each of said blind holes has an open end whose height is larger than a width thereof, and wherein said step of securing said blank or said nozzle plate to said front end face of said ink-chamber member comprises: providing one of said blank or nozzle plate and said ink-chamber member with a positioning extension; positioning said blank or nozzle plate with respect to said ink-chamber member, in a direction of said height of said open end of said each blind hole, by engagement of said positioning extension with the other of said blank or nozzle plate and said ink-chamber member; and positioning said blank or nozzle plate with respect to said ink-chamber member, in a direction of said width of said open end of said each blind hole, by detecting and adjusting a relative position of said blank or nozzle plate and said ink-chamber member in said direction of said width.

19. A method according to claim 1, wherein each of said blind holes consists entirely of said varying-area portion.

20. A method according to claim 1, wherein said varying-area portion of said each blind hole has a cross sectional shape that gives a decrease in a rate of decrease in said cross sectional area in said direction from said one of opposite surfaces toward said bottom.

21. A method of manufacturing an ink jet head having a plurality of ink chambers to be filled with an ink, and a plurality of ink-jet holes which are formed through a front end wall and which communicate with said plurality of ink chambers, respectively, said method comprising the steps of:

forming a plurality of blind holes in said front end wall of the ink jet head such that said blind holes are open in one of opposite surfaces of said front end wall on a side of said ink chambers and communicate with said ink chambers, respectively, each of said blind holes having a varying-area portion whose cross sectional area decreases in a direction from said one of opposite surfaces of said front end wall toward the other of said one of opposite surfaces; and irradiating simultaneously bottoms of at least a plurality of said plurality of blind holes with a single laser beam, so as to form orifice holes which communicate with the corresponding blind holes.

22. A method of manufacturing an ink jet head including an ink-chamber member having a plurality of ink chambers to be filled with an ink and a nozzle plate which is secured to a front end face of said ink-chamber member and which has a plurality of ink-jet holes communicating with said plurality of ink chambers, respectively, said method comprising the steps of:

forming by injection molding a blank for said nozzle plate, said blank having a plurality of blind holes formed in one of opposite surfaces thereof which corresponds to a surface of said nozzle plate at which said nozzle plate is secured to said front end face of said ink-chamber member, said blank having bottom walls each defining a bottom of said blind holes, respectively, each one said blink holes having a varying-area portion whose cross sectional area decreases in a direction from said one of opposite surfaces toward said bottom, said blind holes being formed such that a size of each of said blind holes at an open end thereof is smaller than a size of the corresponding ink chamber at an end thereof at which said ink chamber communicates with the corresponding ink-jet hole;

laser-cutting said blank to remove at least a portion of each of said bottom walls and thereby form a plurality of orifice holes which cooperate with said blind holes to form said ink-jet holes, whereby said nozzle plate is prepared; and securing said blank to said front end face of said ink-chamber member before said blank is laser-cut, or securing said nozzle plate to said front end face of said ink-chamber member after said nozzle plate is prepared by laser-cutting said blank.

* * * * *